US010807764B2

(12) United States Patent
Tippmann

(10) Patent No.: US 10,807,764 B2
(45) **Date of Patent: *Oct. 20, 2020**

(54) HEAT TRANSFER SYSTEM FOR WAREHOUSED GOODS

(71) Applicant: Tippmann Engineering, LLC, Fort Wayne, IN (US)

(72) Inventor: Daniel J. Tippmann, Fort Wayne, IN (US)

(73) Assignee: Tippmann Engineering LLC, Fort Wayne, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/384,269

(22) Filed: Apr. 15, 2019

(65) Prior Publication Data

US 2019/0241311 A1 Aug. 8, 2019

Related U.S. Application Data

(60) Continuation of application No. 15/845,401, filed on Dec. 18, 2017, now Pat. No. 10,301,067, which is a (Continued)

(51) Int. Cl.
*B65D 19/38* (2006.01)
*B65D 71/00* (2006.01)

(Continued)

(52) U.S. Cl.
CPC ..... *B65D 19/38* (2013.01); *B65D 71/0096* (2013.01); *B65D 81/263* (2013.01); *B65D 2571/00043* (2013.01); *F24F 7/007* (2013.01)

(58) Field of Classification Search
CPC .. B65D 19/38; B65D 71/0096; B65D 81/263; B65D 2571/00043; F24F 7/007

(Continued)

(56) References Cited

U.S. PATENT DOCUMENTS 2,544,743 A * 3/1951 Vrabcak ..... B65D 19/0038 108/51.3
2,603,356 A 7/1952 Hisey (Continued)

FOREIGN PATENT DOCUMENTS

DE 299 10 193 11/2000
EP 0 223 743 5/1987

(Continued)

OTHER PUBLICATIONS

Office Action dated Jan. 18, 2017 in corresponding U.S. Appl. No. 13/844,078.

(Continued)

*Primary Examiner* — Terrell L McKinnon
*Assistant Examiner* — Michael McDuffie
(74) *Attorney, Agent, or Firm* — Faegre Drinker Biddle & Reath LLP

(57) ABSTRACT

Systems and methods for airflow management around palletized cases of goods in a warehouse storage facility are provided, in which airflow around each individual layer of cases is facilitated while airflow "spillage" around the sides, top or bottom of pallet assemblies is minimized or eliminated. One exemplary device for such airflow management includes palletized product spacers disposed between respective layers of vertically stacked cases, in which the product spacers facilitate a substantially unidirectional longitudinal airflow. Another exemplary airflow management device is a series of automatically adjustable air dams disposed at the tops of respective pallet assemblies which prevent air spillage and establish intermediate air manifold spaces. Yet another device is a lateral pallet spacer prevents direct abutment of the side surfaces of neighboring pallet assemblies and thereby ensures that the air manifold spaces (Continued)

are in fluid communication with the spacers of multiple pallet assemblies.

24 Claims, 26 Drawing Sheets

Related U.S. Application Data division of application No. 14/166,324, filed on Jan. 28, 2014, now Pat. No. 9,873,547, which is a continuation-in-part of application No. 13/844,078, filed on Mar. 15, 2013, now abandoned.

(60) Provisional application No. 61/891,117, filed on Oct. 15, 2013.

(51) Int. Cl.
*B65D 81/26* (2006.01)
*F24F 7/007* (2006.01)

(58) Field of Classification Search
USPC ..... 248/678, 188.1, 188.2, 346.01, 346.02, 248/346.4, 346.5; 165/54; 211/190, 191; 108/54.25, 57.28
See application file for complete search history.

(56) References Cited

U.S. PATENT DOCUMENTS 2,679,111 A * 5/1954 Leischner ..... F26B 9/06 34/306
2,803,356 A 8/1957 Thomas
2,825,211 A 3/1958 Gessel
2,920,807 A 1/1960 Bruce
3,129,071 A 4/1964 Meredith
3,159,115 A 12/1964 Nolan
3,545,223 A 12/1970 Elland
3,621,672 A 11/1971 Meredith
3,638,450 A 2/1972 Falk
3,734,281 A * 5/1973 Armstrong ..... B65D 19/44 193/38
3,776,146 A * 12/1973 Morrison ..... B65D 19/0036 108/52.1
3,805,473 A 4/1974 Lidgard
3,861,326 A 1/1975 Brown
3,863,831 A 2/1975 Wozniacki et al.
3,934,789 A * 1/1976 Allman ..... B65D 1/34 229/407
3,982,638 A 9/1976 Lamson
D241,777 S 10/1976 Allman et al.
4,042,127 A * 8/1977 Brossia ..... B65D 19/00 108/51.3
4,063,432 A 12/1977 Chaussy et al.
4,221,421 A 9/1980 Bettker, Jr. et al.
4,284,259 A * 8/1981 McCaskill ..... B65D 19/00 108/51.3
4,377,935 A 3/1983 Curtis
4,425,768 A 1/1984 Burns
4,467,728 A 8/1984 Horne
D288,977 S 3/1987 Wind
4,934,255 A 6/1990 McDonnell et al.
5,000,253 A 3/1991 Komarnicki
5,041,298 A 8/1991 Wallace et al.
5,054,291 A 10/1991 Davis et al.
5,101,643 A 4/1992 Hicke
5,127,619 A * 7/1992 Bleim ..... B65D 57/00 248/346.01
5,168,817 A 12/1992 Nulle et al.
5,211,117 A 5/1993 Beamer
5,246,397 A 9/1993 Petter
5,273,170 A 12/1993 Azzopardi et al.
D343,041 S 1/1994 Beasley
5,295,445 A 3/1994 Locke et al.
5,401,520 A 3/1995 Skaar et al.
5,419,153 A 5/1995 Hartley
5,425,521 A * 6/1995 Locke ..... B65D 11/16 108/57.17
5,475,926 A 12/1995 Bolkestein et al.
5,706,662 A 1/1998 Van
5,778,557 A 7/1998 Leavens
5,789,007 A 8/1998 Bianco
5,965,185 A 10/1999 Bianco
6,018,927 A * 2/2000 Major ..... B32B 3/28 52/793.1
6,047,813 A 4/2000 Herzog et al.
6,340,043 B1 1/2002 Paupardin
6,453,827 B1 9/2002 Perazzo
6,478,669 B1 11/2002 Van
6,598,847 B2 * 7/2003 Doucet ..... B65D 71/0092 108/56.3
6,632,067 B1 10/2003 Ouellette
6,804,939 B2 10/2004 Samborn et al.
6,901,768 B1 6/2005 Windecker
D513,104 S 12/2005 Harding et al.
7,178,356 B1 2/2007 Lingelbach et al.
7,188,666 B2 3/2007 Lee et al.
7,194,337 B2 3/2007 Sharma et al.
7,516,624 B2 4/2009 Weeth
7,607,628 B2 * 10/2009 Elder ..... B65D 19/0036 108/53.3
7,726,144 B2 6/2010 Larson et al.
7,823,409 B2 11/2010 Colding-Kristensen et al.
7,832,218 B2 11/2010 Hawkins
7,895,853 B2 3/2011 Tillman, Jr. et al.
8,087,869 B1 1/2012 Binford
D655,475 S 3/2012 Lin
8,132,771 B2 * 3/2012 Lee ..... B60P 7/08 108/53.1
8,220,287 B2 7/2012 Tippmann et al.
8,281,612 B2 10/2012 Weeth
D682,503 S 5/2013 Fehrman, Jr. et al.
8,459,180 B2 6/2013 Paupardin et al.
8,551,597 B2 10/2013 Kowalski et al.
8,783,047 B2 7/2014 Tippmann
8,838,481 B2 9/2014 Moshfeghi
8,882,076 B2 * 11/2014 Scelfo ..... B65D 19/38 211/164
8,988,879 B2 3/2015 Hamburgen et al.
D732,789 S 6/2015 Tippmann
9,080,039 B2 7/2015 Shin et al.
9,297,570 B2 3/2016 Tippmann
10,301,067 B2 * 5/2019 Tippmann ..... B65D 19/38
2002/0025776 A1 2/2002 Onken
2004/0159267 A1 * 8/2004 Markling ..... B29C 49/20 108/57.25
2006/0185528 A1 8/2006 Tippmann et al.
2006/0207284 A1 9/2006 Lehmann et al.
2006/0272350 A1 12/2006 Weeth
2007/0175236 A1 8/2007 Dryzun
2007/0231116 A1 10/2007 Kimener
2008/0053342 A1 * 3/2008 Muirhead ..... B65D 19/0012 108/57.25
2009/0025343 A1 1/2009 Salm
2011/0107784 A1 5/2011 Tippmann et al.
2011/0187022 A1 8/2011 Muirhead
2011/0300329 A1 12/2011 Kowalski et al.
2012/0227419 A1 9/2012 Tippmann et al.
2012/0227436 A1 9/2012 Tippmann et al.
2012/0231139 A1 9/2012 Tippmann et al.
2012/0272500 A1 11/2012 Reuteler
2012/0324912 A1 12/2012 Tippmann et al.
2013/0136573 A1 * 5/2013 Berry ..... B65D 19/0038 414/800
2013/0172444 A1 7/2013 Shin et al.
2013/0298592 A1 11/2013 Hill, Jr.
2013/0325673 A1 12/2013 Abdic et al.
2014/0027523 A1 1/2014 Kloepfer
2014/0273801 A1 9/2014 Tippmann

(56) References Cited

U.S. PATENT DOCUMENTS

| | | | | |
|---|---|---|---|---|
| 2014/0326432 | A1 | 11/2014 | Dean et al. | |
| 2015/0059624 | A1* | 3/2015 | Kuo ..... | B65D 19/0018 108/57.28 |
| 2016/0377304 | A1 | 12/2016 | Rigaud | |

FOREIGN PATENT DOCUMENTS

| | | |
|---|---|---|
| EP | 0 452 844 | 10/1991 |
| EP | 1 475 589 | 3/2004 |
| EP | 1 766 303 | 6/2006 |
| FR | 2 871 222 | 12/2005 |
| JP | 05295355 | 11/1993 |
| JP | 3138535 | 1/2008 |
| WO | 2005/106356 | 11/2005 |
| WO | 2007/122334 | 11/2007 |

OTHER PUBLICATIONS

Response to Office Action dated Jan. 18, 2017 filed Apr. 18, 2017 in corresponding U.S. Appl. No. 13/844,078.
Office Action dated Jul. 27, 2017 in corresponding U.S. Appl. No. 13/844,078.
SFB Plastics, Inc., "Freezer Spacers, Superior Design and Construction" Product Information, 2002.

* cited by examiner

HEAT TRANSFER SYSTEM FOR WAREHOUSED GOODS

CROSS-REFERENCE TO RELATED APPLICATIONS

This application is a continuation of U.S. patent application Ser. No. 15/845,401, filed Dec. 18, 2017 and entitled HEAT TRANSFER SYSTEM FOR WAREHOUSED GOODS, which is a divisional of U.S. patent application Ser. No. 14/166,324, filed Jan. 28, 2014 and entitled HEAT TRANSFER SYSTEM FOR WAREHOUSED GOODS, which is a continuation-in-part of U.S. patent application Ser. No. 13/844,078, filed Mar. 15, 2013 and entitled SPACER FOR A WAREHOUSE RACK-AISLE HEAT TRANSFER SYSTEM. U.S. patent application Ser. Nos. 14/166,324 and 15/845,401, and therefore this application, also claim the benefit of US Provisional Patent Application Ser. No. 61/891,117, filed Oct. 15, 2013 and entitled HEAT TRANSFER SYSTEM FOR WAREHOUSED GOODS. The entire disclosures of all of the above-mentioned applications are hereby expressly incorporated herein by reference.

BACKGROUND

1. Technical Field

The present disclosure relates to a warehouse that is capable of altering and/or holding steady the temperature of a quantity of product housed in cases forming pallet assemblies and storing such product, e.g., bulk foods. More particularly, the present disclosure relates to spacing, stacking and heat transfer structures used in such a warehouse.

2. Description of the Related Art

Freezer warehouses are known in which large pallets of items including meats, fruit, vegetables, prepared foods, and the like are frozen in blast rooms of a warehouse and then are moved to a storage part of the warehouse to be maintained at a frozen temperature until their removal.

U.S. patent application Ser. No. 12/877,392 entitled "Rack-Aisle Freezing System for Palletized Product", filed on Sep. 8, 2010, the entire disclosure of which is hereby explicitly incorporated by reference herein, relates to an improved system for freezing food products. Shown in FIG. 1 is a large warehouse 2 that can be used to freeze and maintain perishable foods or like products. Large pallets of items, including meats, fruits, vegetables, prepared foods, and the like, are sent to warehouse 2 to be frozen employing a system whereby the palletized foods are frozen on storage racks.

FIG. 2 shows a top view of the interior of warehouse 2, in which rows of palletized product are shown such that pallet assemblies 52*a* abut chamber 6. As shown in FIG. 3, rows of racking 14 (see also FIG. 8) are positioned between aisles 10 and chambers 6. Each chamber 6 is enclosed by a pair of end walls 15 and top panel 17. Spacers 20 (FIGS. 5-7) separate respective rows of cases 22 to create a palletized product stack in the form of pallet assembly 52*a* which can be disposed and sealed against the exterior of racking 14 (FIG. 3) via forklifts 18 (see, e.g., FIGS. 3 and 4).

Air handlers 8, e.g., chillers (FIG. 2) provided in the interior of warehouse 2 produce conditioned, e.g., cold air and maintain the temperature of ambient air within the warehouse space at a desired temperature, e.g., +55° F. to −30° F. While warehouse 2 could be utilized to either freeze or thaw a quantity of product housed in cases contained on pallet assemblies 52*a*, the remaining description will use the example of a warehouse freezer, it being understood that similar arrangements and principles will be applied to a warehouse utilized to thaw product, with the air handler comprising a heater as opposed to a chiller.

Adjacent pairs of racking structures 14 (FIGS. 2-4) define a plurality of adjacent airflow chambers 6 (FIGS. 2 and 4) having air intake openings on opposite sides thereof and a plurality of air outlets having air moving devices, such as exhaust fans 12, on top panels 17, which cause freezing air to be drawn into chambers 6 through the air intake openings in racking 14 and to then exhaust into the warehouse space. The plurality of airflow chambers 6 are each defined by a pair of end walls 15 and top wall 17 having one or more air outlets and exhaust fans 12 associated therewith (FIG. 3). Pallet assemblies 52*a* (FIG. 5) are pressed against the intake openings in racking 14 such that a seal is formed between the pallets and the intake openings via side periphery seals, a bottom periphery seal, and a top periphery seal. The seals together define each respective intake opening. Freezing air is drawn through air pathways 16 (FIGS. 2, 4, and 5) within the palletized product in a direction towards chamber 6 to thereby quickly freeze the product. As shown in FIG. 5, spacers 20 may be placed between rows of cases 22 of product in an attempt to provide air pathways 24 through which airflow can enter chamber 6.

U.S. patent application Ser. No. 13/074,098 entitled "Swing Seal for a Rack-Aisle Freezing and Chilling System", filed on Mar. 29, 2011, the entire disclosure of which is hereby explicitly incorporated by reference herein, discloses a top periphery seal useable to seal an intake opening as described above and which automatically adjusts to the height of pallet assembly 52*a* as illustrated in FIG. 6. As illustrated in FIG. 6, pallet assembly 52*a* (comprised of a plurality of cases 22 stacked on spacers 20 and pallet 4) can be positioned along pallet guide 56 and pressed against intake opening 54 such that a seal is formed between pallet assembly 52*a* and intake opening 54 via side periphery seals, a bottom periphery seal and an automatically adjustable top periphery seal surrounding intake opening 54. With such a construction, chilling or freezing air is drawn through air pathways 16 formed through pallet assembly 52*a*, as illustrated in FIGS. 2, 4 and 5.

FIG. 5 illustrates predicate spacer 20 which is formed in an undulating "egg carton" configuration. As illustrated in FIG. 7, individual cases 22 can crush under the weight of the product contained therein and the product contained in cases stacked directly above to cause overlap of cases 22 with a spacer 20 and prohibit airflow between product cases 22 positioned on opposite sides of the obstructed spacer 20. Undulating spacers 20 are particularly susceptible to obstruction due to drooping or sagging cases 22 due to the inconsistent support structure caused by the "hill and valley" configuration of such spacers. FIG. 7 illustrates case crushing and drooping at various sides and levels of pallet assembly 52*a*; however, this phenomenon is, in practice, more prevalently seen with respect to the spacers 20 separating lower rows of cases 22, as the bottom of pallet assembly 52*a* contains the heaviest cumulative load of cases 22 stacked thereon.

In the above described installation, utilizing "egg carton" spacers 20, heat transfer from chilled ambient air in warehouse 2 to the products contained in cases 22 is effected through forced convection which is facilitated by the irregular shape of egg carton spacers 20 to allow airflow in all directions through pallet assembly 52*a*. Alternative spacers such as wood slat spacers may also be utilized to separate cases 22 on pallet 4; however, spacers employed in warehouse installations utilized to keep the quantity of product at a desired temperature through forced convection are designed to allow for airflow in all directions. Because air can flow in all directions through predicate spacers 20 described above, thorough cooling or thawing of a product may not be achieved, as air entering between adjacent rows of product cases may exit pallet assembly 52*a* before encountering all of the cases of the row in question. Further, crushing and/or drooping of cases 22 may restrict airflow, as described above.

Another mechanism of heat transfer, i.e., conduction, can also be utilized to transfer heat to or from product. Predicate spacers 20 described above are made either of wood or plastic, which is not sufficiently thermally conductive to effect heat transfer via conduction. Therefore, in installations utilizing such spacers, heat transfer is effected solely by the use of forced convection.

SUMMARY

The present disclosure provides devices and methods for airflow management around palletized cases of goods in a warehouse storage facility, in which airflow around each individual layer of cases is facilitated while airflow "spillage" around the sides, top or bottom of pallet assemblies is minimized or eliminated. One exemplary device for such airflow management includes palletized product spacers disposed between respective layers of vertically stacked cases, in which the product spacers facilitate a substantially unidirectional longitudinal airflow. Another exemplary airflow management device is a series of automatically adjustable air dams disposed at the tops of respective pallet assemblies which prevent air spillage and establish intermediate air manifold spaces. Yet another device is a lateral pallet spacer prevents direct abutment of the side surfaces of neighboring pallet assemblies and thereby ensures that the air manifold spaces are in fluid communication with the spacers of multiple pallet assemblies.

Combination of some or all the present devices and methods for airflow management may facilitate the use of a racking system in which multiple pallet assemblies are arranged side by side within a single deep rack bay and between a loading aisle and an air exhaust pallet, thereby facilitating greater economy of warehouse space without compromising the capacity for a thermal management unit (e.g., blast freezer) to effect a uniform and timely temperature change of each case contained in the racking system.

The disclosure, in one form thereof, provides a spacer for use between adjacent pairs of stacked cases, the spacer comprising: a plurality of substantially planar, elongate upper support surfaces extending in a first x-y plane of a Cartesian coordinate system; a plurality of substantially planar, elongate lower support surfaces extending in a second x-y plane of a Cartesian coordinate system, the second x-y plane spaced from the first x-y plane by a distance in the z-direction; the lower support surfaces respectively interposed between adjacent pairs of the upper support surfaces; a plurality of sidewalls each connecting one of the upper support surfaces to an adjacent one of the lower support surfaces, such that the upper and lower support surfaces cooperate with the sidewalls to form an undulating profile of lands and valleys, adjacent pairs of the sidewalls each defining an airflow channel having a cross-sectional area defined by a distance between the adjacent pairs of sidewalls along the y-direction and a distance between the upper and lower support surfaces in the z-direction, and each the airflow channel having a longitudinal extent along the x-direction; and a plurality of stiffeners interconnecting the adjacent pairs of the sidewalls with an adjacent one of the upper support surfaces, the stiffeners disposed in a y-z plane.

The disclosure, in another form thereof, provides an installation for cooling to a desired temperature, heating to the desired temperature or maintaining at the desired temperature in a quantity of product, the installation comprising: a plurality of pallet assemblies; a warehouse space having a plurality of racks defining a plurality of bays positioned adjacent to an aisle, each of the plurality of bays sized to receive the plurality of pallet assemblies along a bay depth, the pallet assemblies each loaded with a quantity of product to be set at the desired temperature; at least one air handler operably connected to the warehouse space to condition an ambient air in the warehouse space, the at least one air handler having an output sufficient to achieve and maintain a temperature of the ambient air in the warehouse space at the desired temperature; at least one air flow chamber in fluid communication with a plurality of air intake openings formed through each of the plurality of racks to facilitate airflow into each of the plurality of bays; at least one fan in fluid communication with the at least one air flow chamber, the fan operable to create a circulation of the ambient air flowing through the plurality of air intake openings, through the plurality of pallet assemblies along the bay depth, and finally into the at least one air flow chamber where the ambient air is exhausted back to the warehouse space; at least one of the plurality of pallet assemblies comprising: a pallet having a case support surface defining a case support surface area; a plurality of cases containing the quantity of product, the plurality of cases arranged within a profile defined by the case support surface area; a lateral pallet spacer protruding outwardly from the case support surface area and oriented to abut an adjacent one of the plurality of pallet assemblies when the plurality of pallet assemblies are arranged along the bay depth, whereby the lateral pallet spacer establishes and maintains a lateral separation space between each pair of adjacent pallet assemblies in a respective one of the bays within the plurality of racks; and at least one product spacer, each the product spacer comprising: a substantially planar upper support surface extending in an x-y plane of a Cartesian coordinate system, the upper support surface defining a spacer outer perimeter of a size and shape about congruent to the case support surface area of the pallet; a substantially planar lower support surface spaced from the upper support surface along the z-direction; and a plurality of supports extending between the upper support surface and the lower support surface along a trajectory having a directional component along a z-axis of the Cartesian coordinate system, whereby each of the plurality of supports space the upper support surface from the lower support surface, the upper support surface, the lower support surface and the supports cooperating to define at least one longitudinal airflow channel extending along the x-direction, the at least one airflow channel spanning a pair of opposing sides of the at least one product spacer; each of the plurality of cases stacked on the pallet of one of the plurality of pallet assemblies in a plurality of case layers, each of the plurality of case layers separated from another of the plurality of case layers by one of a plurality of the product spacers; and one of the plurality of pallet assemblies arranged along the bay depth being in an upstream location in direct fluid communication with one of the plurality of air intake openings, such that the circulation created by the at least one fan causes airflow through the channel in the at least one product spacer of the pallet assembly in the upstream location, then into the lateral separation space between the plurality of pallet assemblies arranged along the bay depth, and then through the channel in the at least one product spacer of the next downstream pallet assembly.

The disclosure, in a further form thereof, provides a method of maintaining a quantity of a product at a desired temperature, comprising: preparing a plurality of pallet assemblies by stacking a plurality of cases and a plurality of spacers on respective pallets so that respective rows of the plurality of cases are separated from each one another along a z-axis of a Cartesian coordinate system by the spacers, the spacers comprising: a substantially planar upper support surface extending in an x-y plane of a Cartesian coordinate system, the upper support surface defining a spacer outer perimeter of a size and shape about congruent to a case support surface area of the pallet; a substantially planar lower support surface spaced from the upper support surface along the z-direction; a plurality of supports extending between the upper support surface and the lower support surface along a trajectory having a directional component along a z-axis of the Cartesian coordinate system, whereby each of the plurality of supports space the upper support surface from the lower support surface, the upper support surface, the lower support surface and the supports cooperating to define at least one longitudinal airflow channel extending along the x-direction, the at least one airflow channel spanning a pair of opposing sides of the spacer; and installing a lateral pallet spacer on each pallet assembly, after the step of stacking a plurality of cases and a plurality of spacers on the pallet, such that the lateral pallet spacer protrudes outwardly from a case support area of the pallet along the x-direction; loading the plurality of pallet assemblies into a bay of a rack so that multiple ones of the plurality of pallet assemblies are arranged side by side along the x-direction, and such that each lateral pallet spacer is oriented to abut an adjacent one of the plurality of pallet assemblies; and directing a thermally conditioned airflow into the bay, through an upstream one of the plurality of pallet assemblies via the airflow channel of the spacer, into a manifold space created by the lateral pallet spacer such that a positive air pressure is created in the manifold space, and into a next adjacent downstream one of the plurality of pallet assemblies.

BRIEF DESCRIPTION OF THE DRAWINGS

The above mentioned and other features and objects of this disclosure, and the manner of attaining them, will become more apparent and the disclosure itself will be better understood by reference to the following description of embodiments of the disclosure taken in conjunction with the accompanying drawings, wherein.

Figure 1:
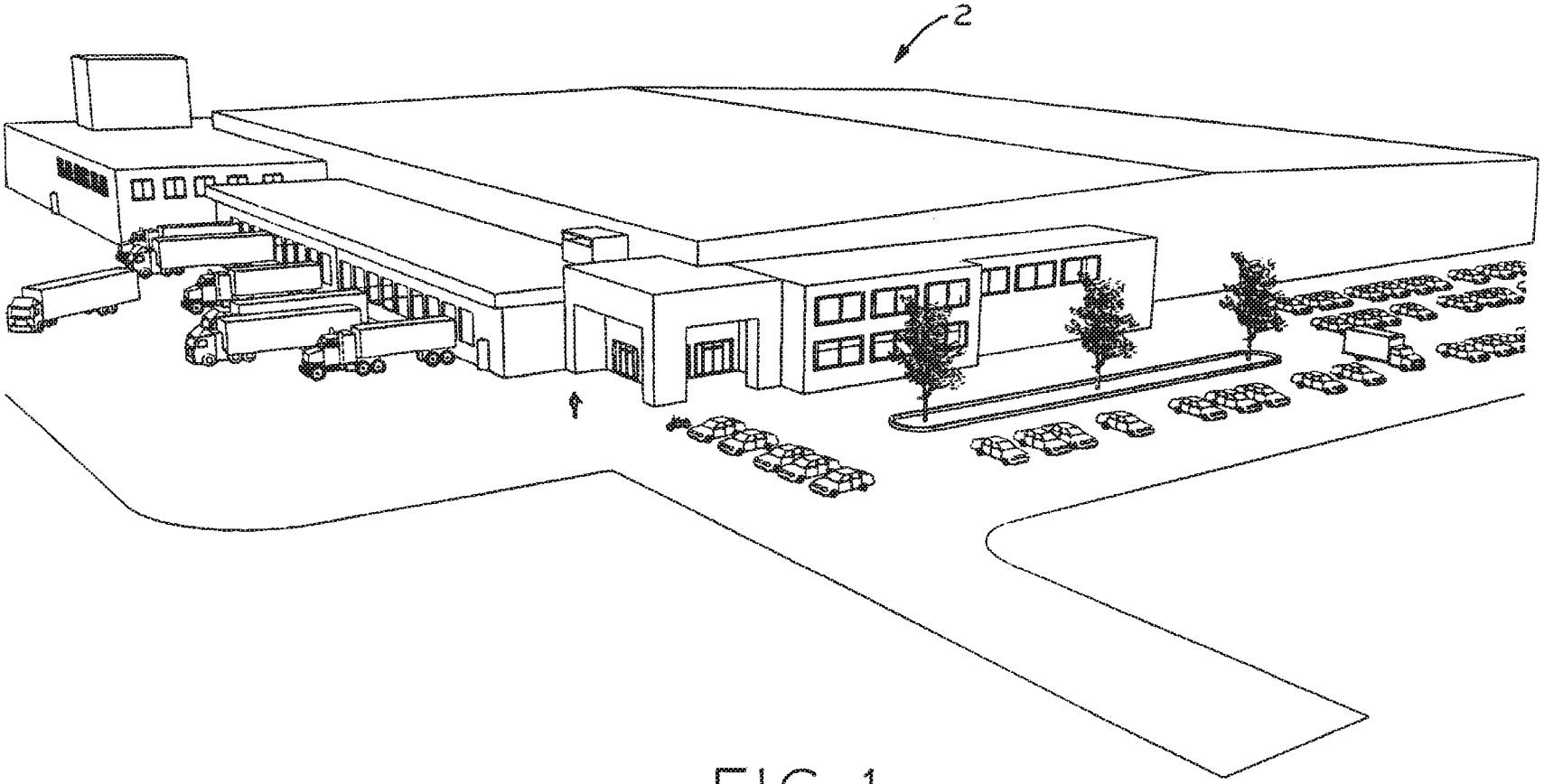
FIG. 1 is a perspective view of a warehouse incorporating a heat transfer system in accordance with the present disclosure.

Corresponding reference characters indicate corresponding parts throughout the several views. Although the exemplifications set out herein illustrate embodiments of the disclosure, in several forms, the embodiments disclosed below are not intended to be exhaustive or to be construed as limiting the scope of the disclosure to the precise forms disclosed.

DETAILED DESCRIPTION

Figure 9:
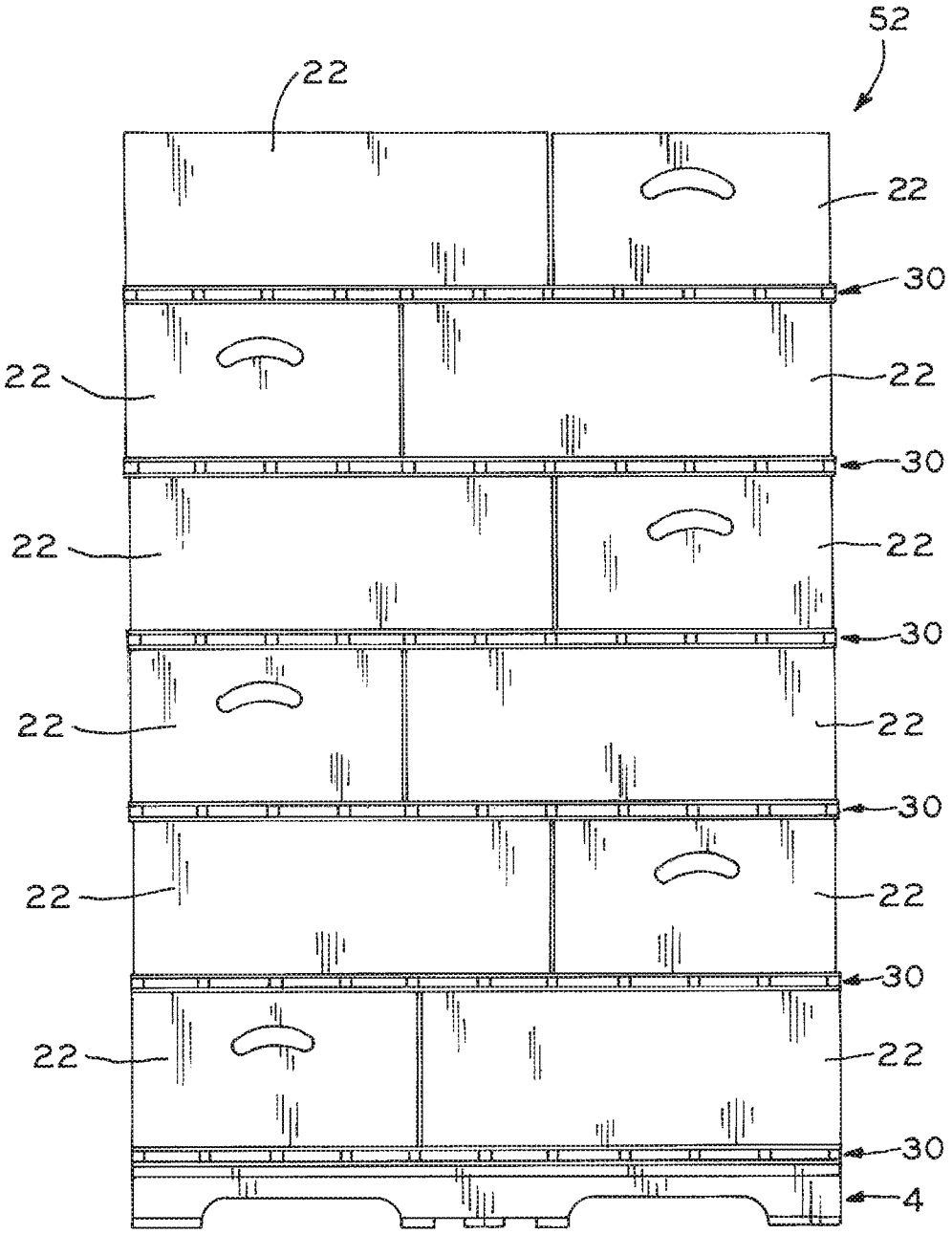
FIG. 9 is an end view of a pallet assembly in accordance with the present disclosure.

As described in detail below, the present disclosure provides a system and method for directing airflow past the upper and lower surfaces of cases 22 contained in respective pallet assemblies 52 (see, e.g., FIG. 9). For example, in industrial blast freezer operations, it is desirable to ensure consistent airflow past the top and bottom surfaces of cases 22 among all the layers thereof within pallet assembly 52, which ensures consistent transfer of heat away from the products contained therein during a blast freezing operation. This consistent heat transfer, in turn, ensures that product contained within cases 22 all freezes at approximately the same time, such that a sampling of temperature readings from among many cases 22 within a warehouse 2 (FIGS. 1-3) will be representative of the temperature of all cases of product placed in warehouse 2, provided cases 22 contain similar product and were initially placed within warehouse 2 at the same time. Thus, where temperature may be sampled at easily accessible outer cases 22 from among an array of pallet assemblies 52, food safety and quality of the non-sampled cases can be ensured by proper airflow and thermal management.

As described in detail below, spacers 30, 130 are provided to facilitate airflow across the entire downstream extent of pallet assemblies 52, thereby ensuring heat transfer airflows to all of cases 22 among the various layers stacked upon pallets 4. In addition, air dams 158 (FIG. 26) and lateral pallet spacers 160 may be provided to create intermediate zones of high pressure between successively downstream pallet assemblies 52, also facilitating downstream airflow past individual layers of cases 22 and even heat transfer resulting from such airflow.

1. Planar Palletized Product Spacer.

Figure 5:
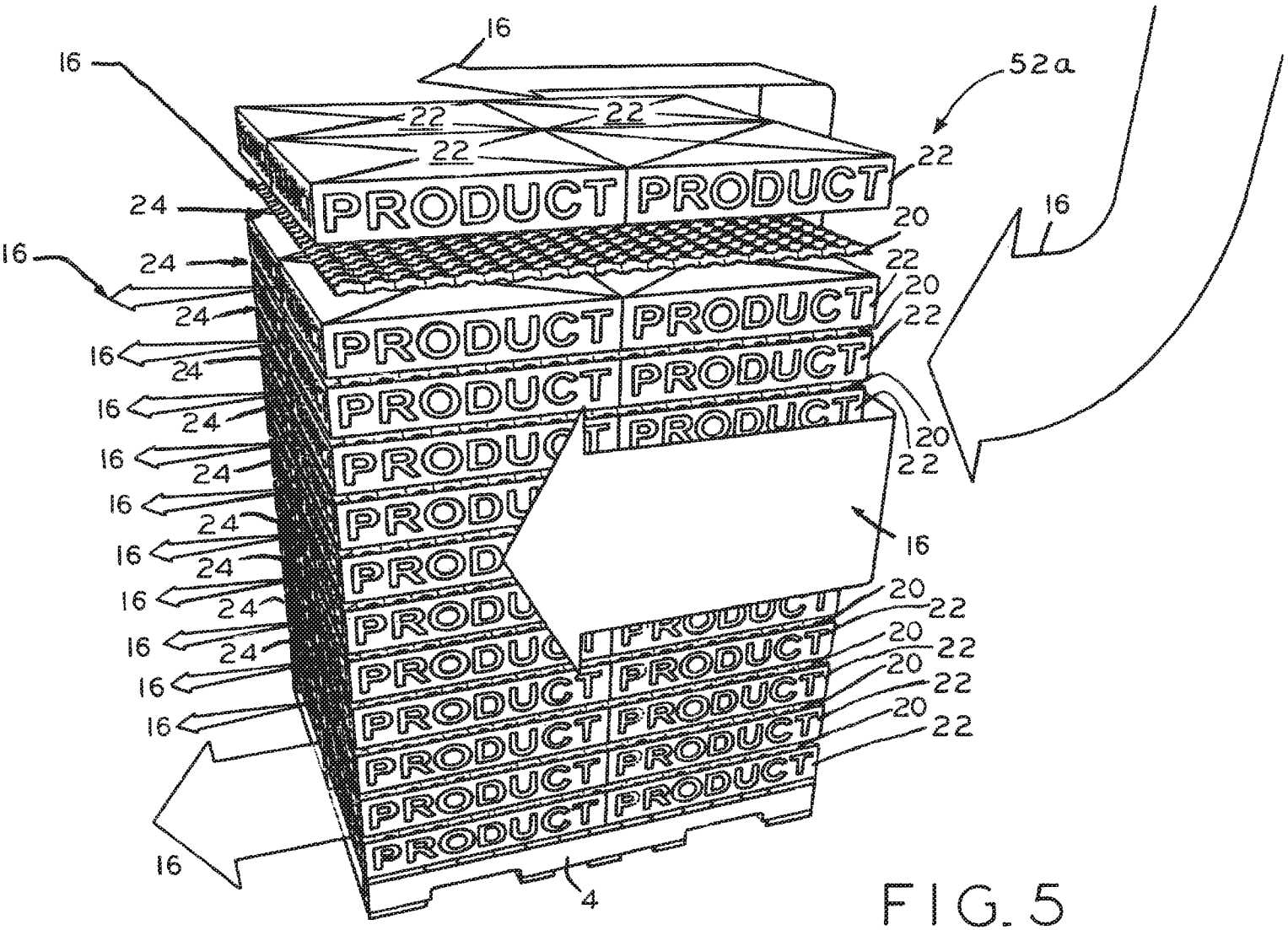
FIG. 5 is a perspective view showing a desired airflow through a pallet assembly.
Figure 6:
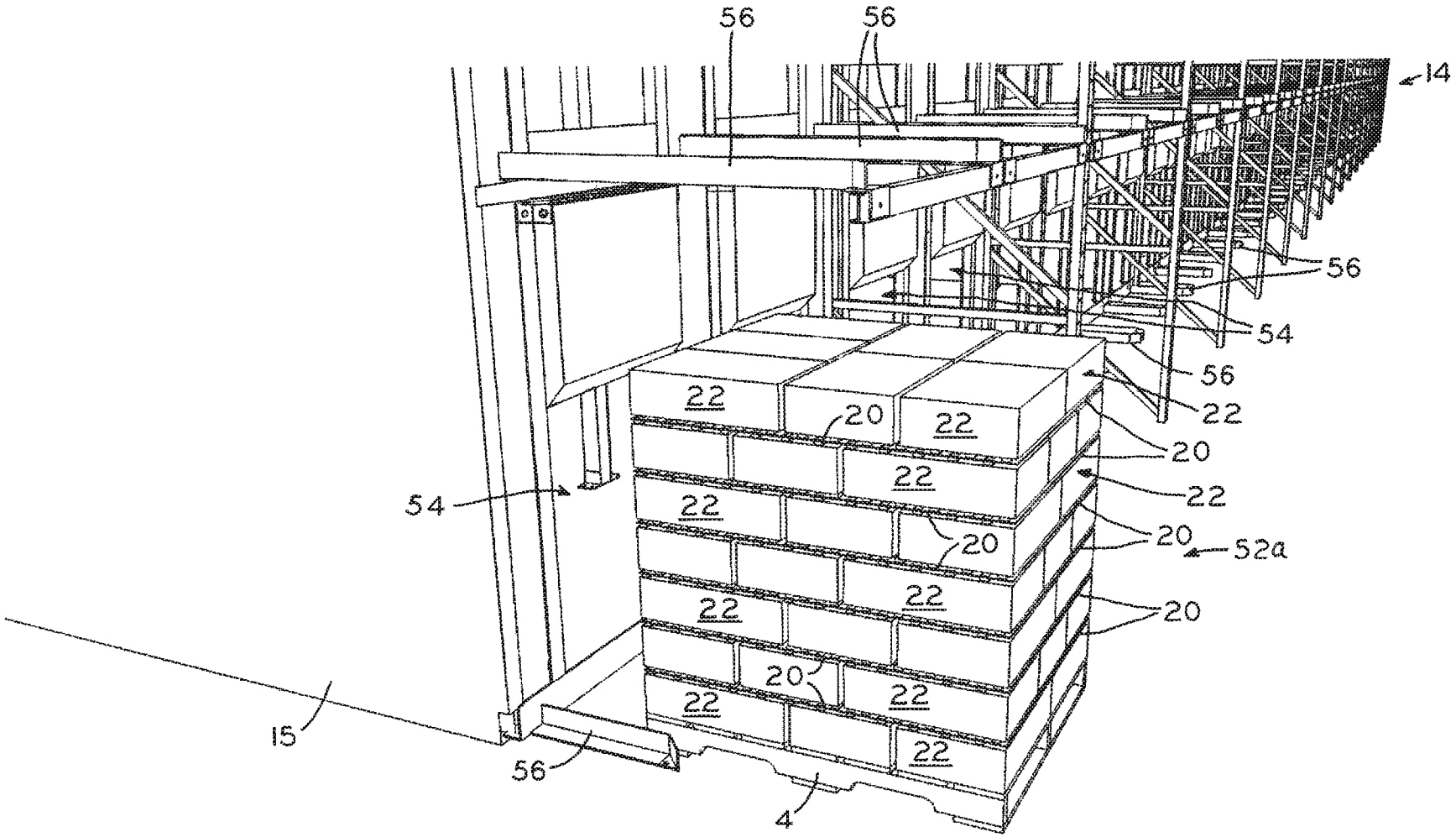
FIG. 6 is a perspective view illustrating loading of pallet assemblies into the racking illustrated, e.g., in FIGS. 3 and 4.
Figure 7:
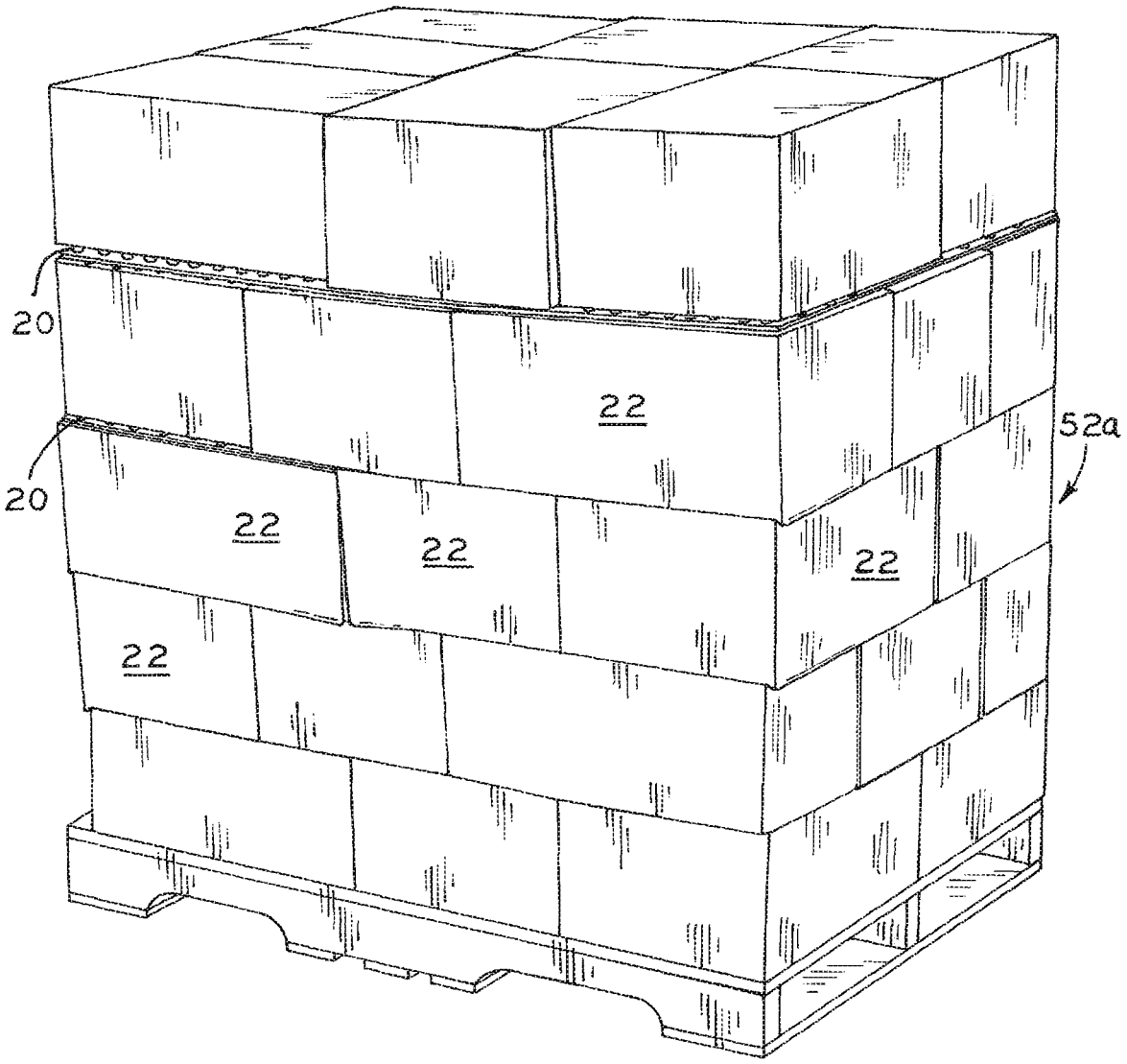
FIG. 7 is a perspective view of a pallet assembly incorporating a predicate spacer.
Figure 10:
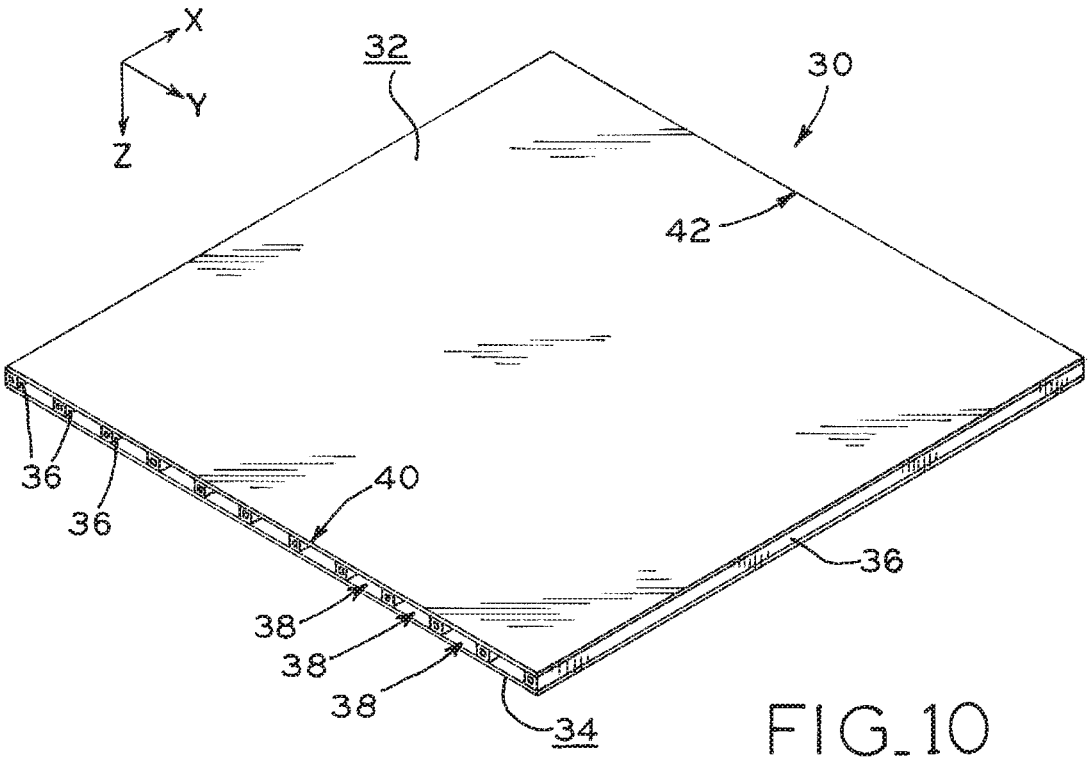
FIG. 10 is a perspective view of a spacer in accordance with the present disclosure.

Referring to FIG. 10, spacer 30 includes a substantially planar first surface 32 extending in an x-y plane of a Cartesian coordinate system. For the purposes of this document, "substantially planar" is meant to denote nominally planar. Similarly, spacer 30 includes substantially planar second surface 34 opposite first surface 32 and extending generally parallel to first surface 32. Substantially planar first surface 32 and substantially planar second surface 34 both present a consistent support structure for abutting cases 22, as depicted in FIG. 9. Because of the consistent support surface provided by substantially planar first surface 32 and substantially planar second surface 34, the drooping and blockage of airflow associated with egg carton spacer 20 (see, e.g. FIGS. 5 and 7) is avoided.

Substantially planar first surface 32 and substantially planar second surface 34 are both formed from plates of material having a thermal conductivity of at least 3 W/m·K, at least 5 W/m·K, or at least 10 W/m·K so that spacer 30 is operable to effect heat transfer with product contained in cases 22 via conduction. Referring to FIG. 10, supports 36 extend between first surface 32 and second surface 34 to define a plurality of airflow channels 38 spanning airflow inlet side 40 and airflow outlet side 42 of spacer 30. Airflow channels 38 may be oriented along either the length or the width of the spacer, depending upon the warehouse installation being utilized. Supports 36 span the entire length of first surface 32 and second surface 34 and block airflow from exiting an airflow channel 38 along a trajectory defined by the y-axis of the Cartesian coordinate system depicted in FIG. 10. When used with reference to a plane or axis of a Cartesian coordinate system, "along" is meant to denote a trajectory coextensive with such plane or axis or parallel to such plane or axis. A plurality of spacers 30 can be utilized to create pallet assembly 52, as illustrated in FIG. 9. In this configuration, pallet assembly 52 is usable in a temperature controlled warehouse to either freeze or thaw a quantity of product housed in cases 22 contained on pallet assemblies 52. With spacers 30, heat transfer to or from the product contained within cases 22 can be effected by both conduction and forced conduction, as further described below. Pallet assemblies 52 in accordance with the present disclosure can be associated with warehouse assembly 2 in the same way as prior art pallet assemblies 52*a* described above.

Figure 2:
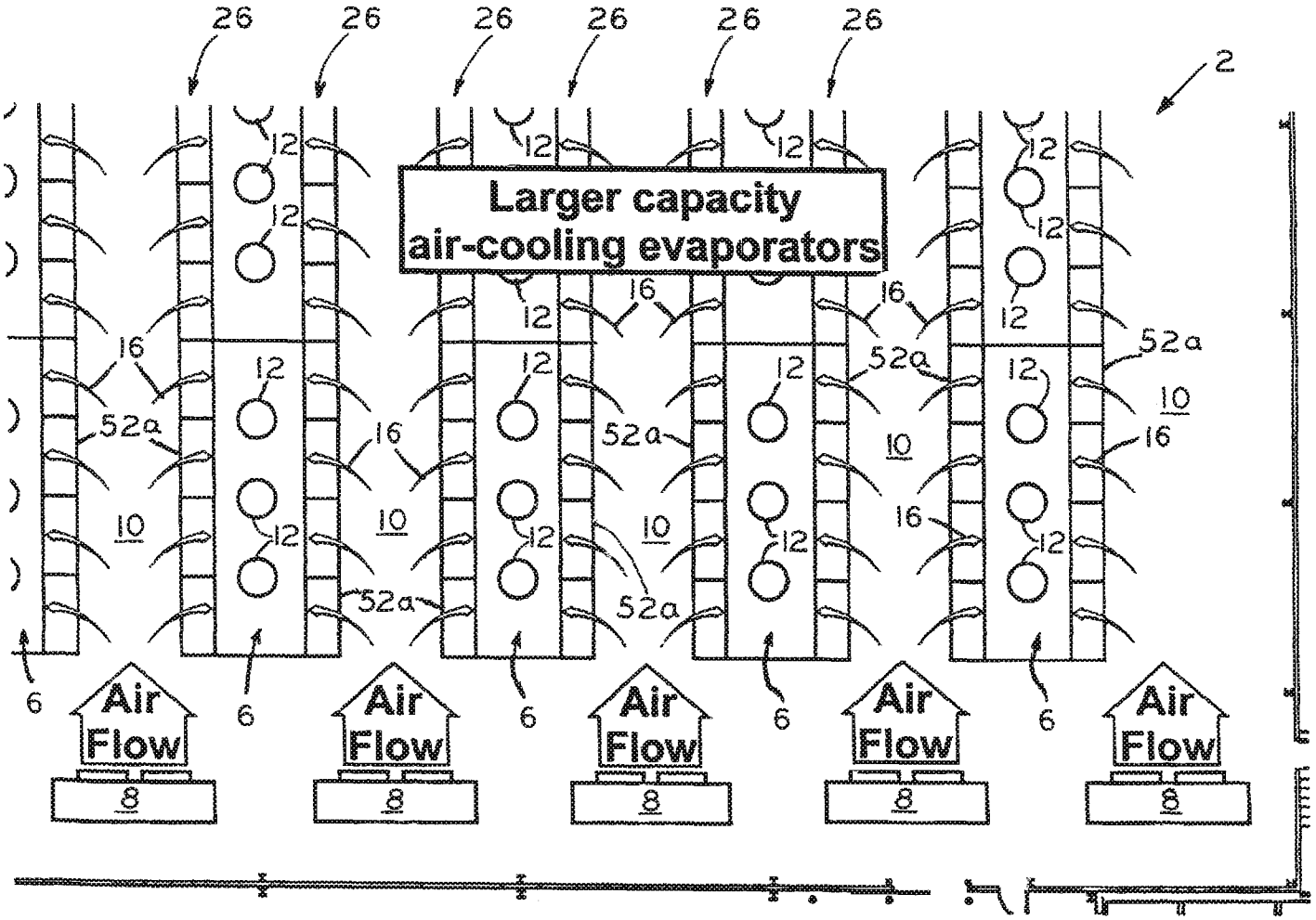
FIG. 2 is a diagrammatic top view of a heat transfer warehouse incorporating the system of the present disclosure.
Figure 3:
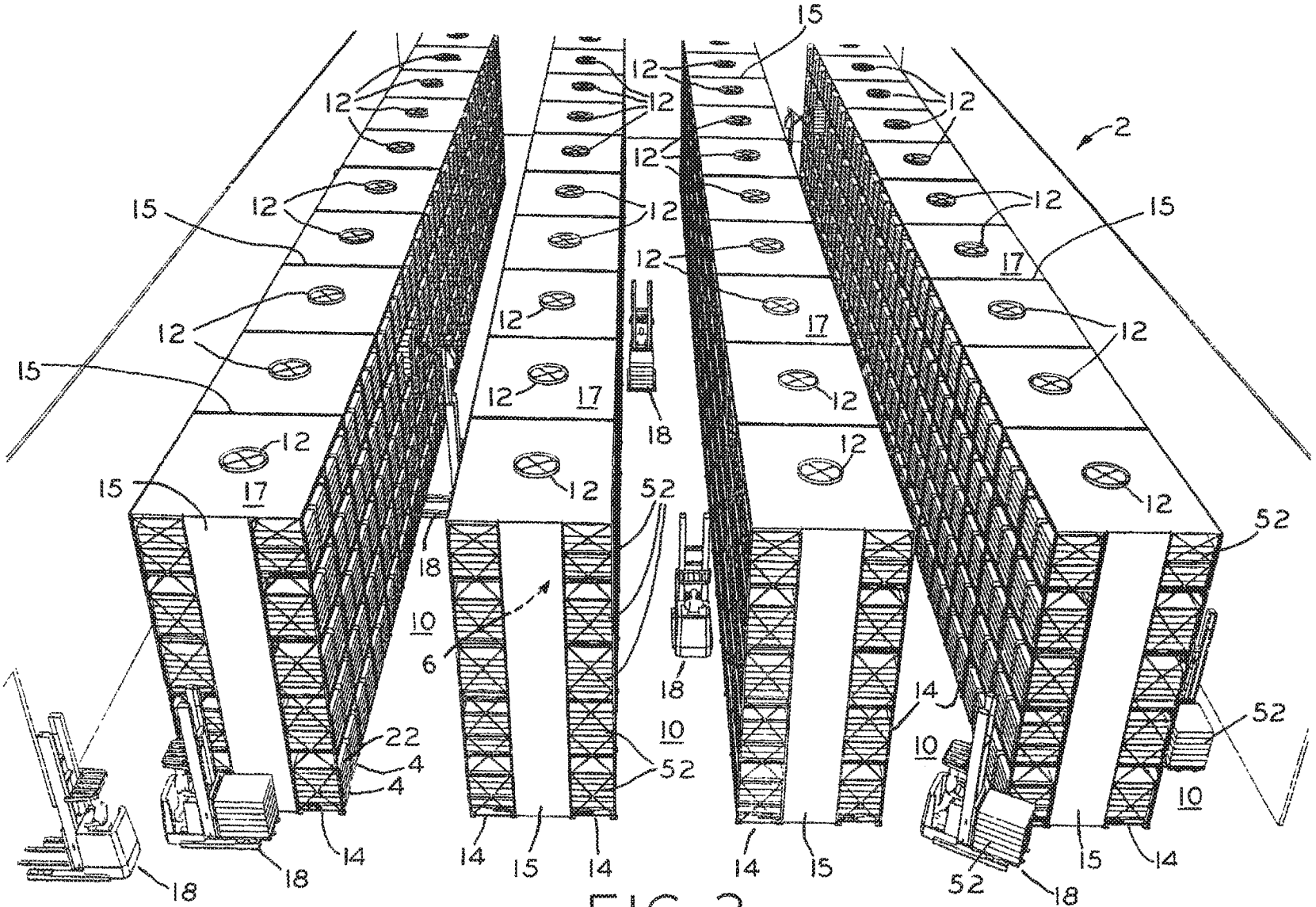
FIG. 3 is a perspective view of the interior of the warehouse illustrated in FIG. 1.
Figure 4:
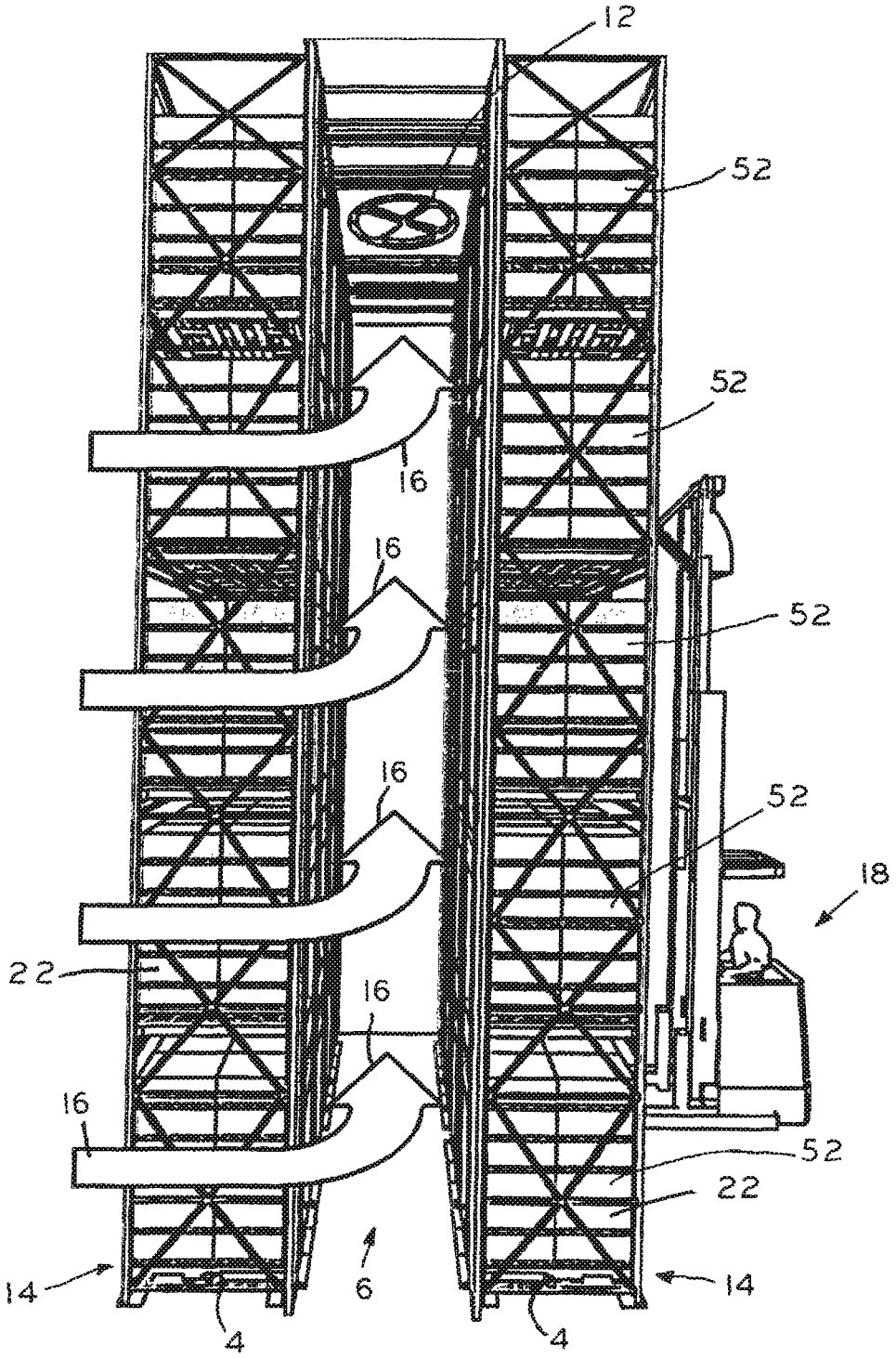
FIG. 4 is a perspective, end view of two rows of racking separated by an airflow chamber.
Figure 8:
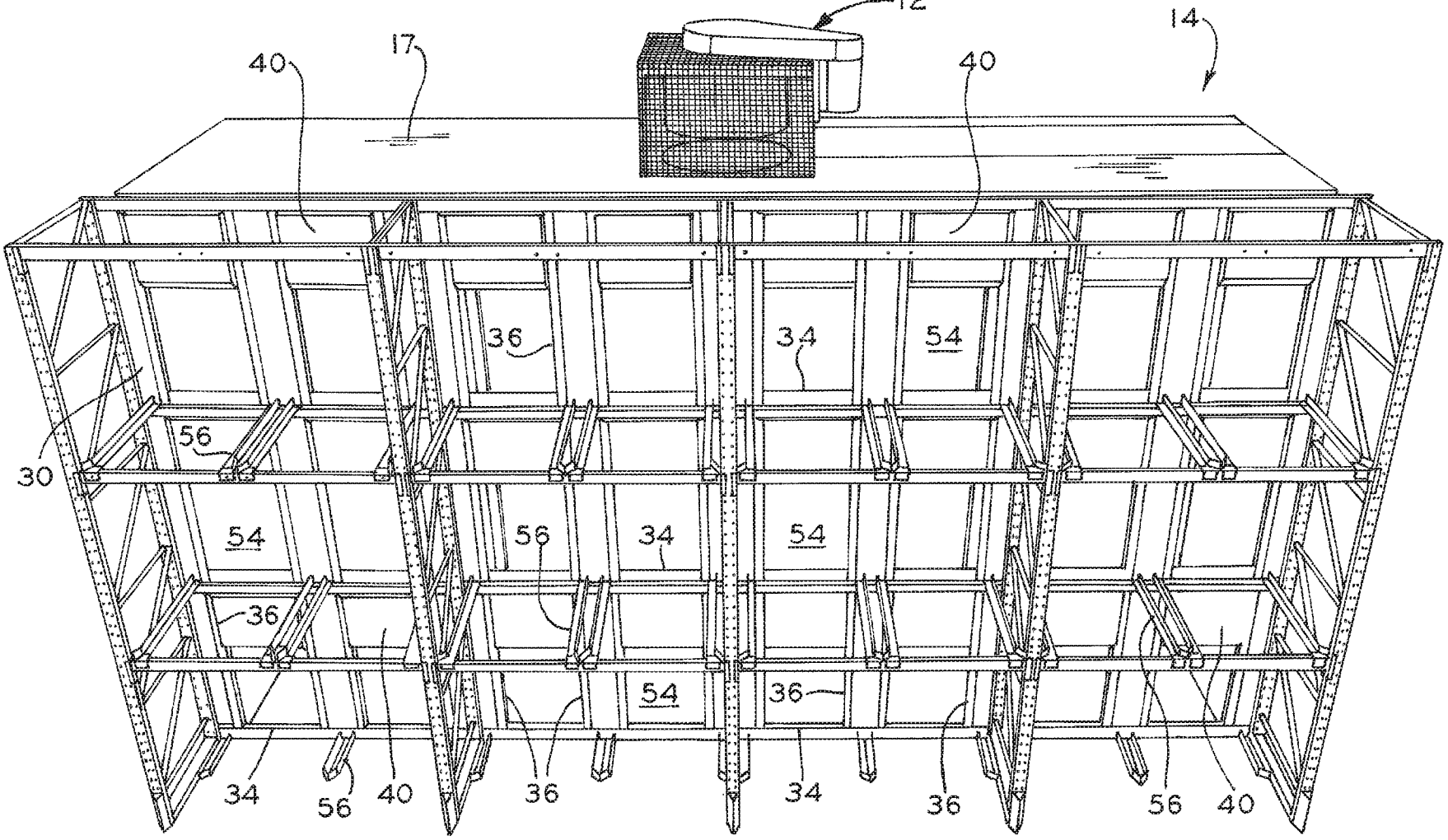
FIG. 8 is a perspective view of a portion of a racking structure accommodating 24 pallet assemblies on each side thereof.

Pallet assemblies 52 form a part of warehouse installation 2 depicted, e.g., in FIG. 2. The general structure and components of warehouse 2 are described above in the background section of this document. A portion of this description will be repeated here to facilitate an understanding of the present invention. As illustrated in FIG. 2, warehouse 2 includes rack rows 26 separated by chambers 6 and aisles 10. As illustrated in FIGS. 3 and 4, racks 14 are sized for receiving a plurality of pallet assemblies 52. As depicted, e.g., in FIG. 9, pallet assemblies 52 include pallet 4, on which a plurality of cases 22 are stacked, with spacers 30 interposed between layers of cases 22. Racking 14 can be sized to receive a different number of pallet assemblies, as necessary. Different assemblies of racking 14 are illustrated, e.g., in FIGS. 3, 4 and 8.

With pallet assemblies 52 arranged in rows and columns on racks 14, warehouse installation 2 can be utilized to maintain the quantity of product contained in cases 22 at a desired temperature. As illustrated in FIGS. 3 and 4, aisles 10 are sufficiently wide to allow forklifts 18 to access pallet assemblies 52. Typical aisle width is between 5 feet to 14 feet depending on the type of lift equipment. Pallet assemblies 52 each include a pallet 4 at the bottom thereof. As used in this document, "pallet" is used to denote a standard warehouse pallet of box section open at least two ends (some pallets are called 4-way pallets due to fork openings on all 4-sides) to allow the entry of the forks of a forklift so that a palletized load, i.e., pallet assembly 52, can be raised and moved about easily.

As described above, racks 14 define air intake openings fluidly connected to a chamber 6, which, in the exemplary embodiment illustrated is enclosed by a pair of end walls 15 and top panel 17. Pallet assemblies 52 are disposed and sealed against the air intake openings formed in racks 14. Referring to FIG. 2, air handlers 8 are operably connected to warehouse space 2 so that air handlers 8 can condition the ambient air in warehouse space to a desired temperature. In the event that warehouse space 2 is utilized to freeze product contained in cases 22, air handlers 8 may produce air on the order of −5° F. to −30° F. In the event that warehouse space 2 is utilized to thaw product contained in cases 22, air handlers 8 may produce air on the order of 30° F. to 60° F. Fans 12 circulate ambient air conditioned by air handlers 8 such that air conditioned by air handlers 8 flows through pallet assemblies 52 and thereafter through the air intake openings formed in racks 14.

As mentioned above, each pallet assembly 52 includes a plurality of cases 22 stacked atop a pallet 4, with spacers 30 separating each layer of cases 22. Referring to FIG. 10, each spacer 30 includes substantially planar first surface 32 and substantially planar second surface 34, with a plurality of supports 36 extending between first surface 32 and second surface 34 along a trajectory defined by the z-axis of the Cartesian coordinate system illustrated in FIG. 10. Stated another way, first surface 32 is separated from second surface 34 along the z-axis by supports 36. First surface 32 and second surface 34 extend in the x-y plane of the Cartesian coordinate system illustrated in FIG. 10.

Each of first surface 32 and second surface 34 are sized and shaped to be about congruent to the outer perimeter of pallet 4. In one exemplary embodiment, pallet 4 comprises a standard 40 inch by 48 inch rectangular outer perimeter. With such a pallet, first surface 32 and second surface 34 will both be substantially rectangular in shape and about 40 inches by about 48 inches. Stated another way, first surface 32 and second surface 34 are both nominally rectangular and nominally measure about 40 inches by 48 inches. In certain alternative embodiments, spacers 30 will be slightly oversized with respect to pallet 4, e.g., by having an overhang of up to an inch relative to the perimeter of pallet 4. These embodiments are also considered to be sized and shaped "about congruent" to the outer perimeter of pallet 4. Alternative pallet sizes, such as a standard European pallet may be utilized. Spacers 30 will be about congruent to whatever pallet they are designed for use with.

In certain embodiments, spacers 30 will be oversized along the z-axis of the Cartesian coordinate system depicted in FIG. 10. For example, spacer 30 may include a dimension of about 41 inches along the z-axis as compared to a corresponding dimension of pallet 4 of 40 inches. Because cases 22 are sized to be positioned into configurations corresponding to the standard 40 inch by 48 inch pallet, a spacer sized at 41 inches along the x-axis can provide for an overlap of one inch with respect to a row of cases at either airflow inlet side 40 or airflow outlet side 42. A spacer 30 measuring 41 inches along the x-axis may also be utilized to provide an overlap of one-half inch at both airflow inlet side 40 and airflow outlet side 42. In an alternative embodiment, spacer 30 measures 42 inches along the x-axis to provide for additional overlap. In this embodiment, the consistent surfaces provided by substantially planar first surface 32 and substantially planar second surface 34 together with the overlap along the x-axis cooperate to prevent drooping or sagging of cases 42 which would block airflow through channels 38, which is further described hereinbelow. Generally speaking, it is contemplated that spacer 30 may have any dimension along the x-axis between 40 and 42 inches.

Supports 36 extend along the x-axis of the Cartesian coordinate system depicted in FIG. 10. Supports 36 cooperate with the opposing plates forming substantially planar first surface 32 and substantially planar second surface 34 to form airflow channels 38 spanning opposing sides of spacer 30. Specifically, airflow channels 38 span air inlet side 40 and air outlet side 42. Channels 38 allow a flow of conditioned air created by air handlers 8 and circulated by fans 12 to enter airflow inlet side 40 of channels 38, traverse channels 38 and exit through airflow outlet side 42 of spacer 30. In the exemplary embodiment illustrated in FIGS. 9, 10 and 12, supports 36 are formed of extruded aluminum box tubes. In an exemplary embodiment, the extruded aluminum box tubes forming supports 36 are formed of 14 gauge aluminum forming a tube having a square outer perimeter and a square inner perimeter defining a longitudinal channel extending the length of support 36.

Each support 36 is secured to an aluminum plate defining first surface 32 and a second aluminum plate defining second surface 34. In an exemplary embodiment, the opposing aluminum plates are formed of 14 gauge aluminum. When formed of aluminum, spacer 30 may have a thermal conductivity of at least 10 W/m·K. Supports 36 may be secured to the opposing plates using a variety of techniques including welding. Alternative materials of construction may be utilized to form spacers 30, including various metals and polymers such as high density polyethylene or polycarbonate may be utilized. If polymeric material is utilized to form spacers 30, then they can have a thermal conductivity of at least 3 W/m·K or at least 5 W/m·K.

Airflow channels 38 defined by supports 36 are longitudinal voids having a cross-section extending across the opposing plates on which first surface 32 and second surface 34 of spacer 30 are formed and between neighboring pairs of supports 36. Airflow channels 38 provide a longitudinal airflow, i.e., a directional flow generally along the x-axis of the Cartesian coordinate system depicted in FIG. 10.

When airflow traverses airflow channels 38 from airflow inlet side 40 to airflow outlet side 42, the flow within channels 38 may at times be turbulent, such that the airflow has vector components along the y- and z-axes of the Cartesian coordinate system depicted in FIG. 10; however, the gross airflow remains along the x-axis. That is, securement of supports 36 to the opposing plates defining first surface 32 and second surface 34 substantially preclude the airflow from exiting airflow channels 38 along a trajectory defined by the y-axis. While minor discontinuities in the securement of supports 36 to the plates forming first surface 32 and second surface 34 may allow a very minor bit of airflow leakage along the y-axis, such losses will be small. Air losses from airflow channels 38 will ideally be nonexistent. In certain exemplary embodiments, accounting for manufacturing processes, airflow loss from airflow channels 38 along a trajectory defined by the y-axis could be approximately 2% or maybe even as high as 5%. In these instances, supports 36 will still be said to substantially preclude airflow from exiting airflow channels 38 along a trajectory defined by the y-axis of the Cartesian coordinate system. Similarly, the opposing plates on which first surface 32 and second surface 34 are formed preclude airflow from exiting airflow channels 38 along the z-axis. This structure therefore provides for no loss of heat transfer by the escape of airflow through the sides of spacer 30 spanning airflow inlet side 40 and airflow outlet side 42, which enhances the efficiency of heat transfer in an installation arranged in accordance with the present disclosure.

Generally speaking, the top plate and bottom plate of spacers 30 from which substantially planar first surface 32 and substantially planar second surface 34 are defined, are formed of a material having a thermal conductivity of at least 3 W/m·K (watts per meter kelvin), at least 5 W/m·K, or at least 10 W/m·K. Therefore, heat transfer between spacers 30 and the product contained in cases 22 will occur via conduction as well as forced convection (with the circulating airflow of warehouse 2 contacting cases 22 between spacers 30). Because of the consistent surface provided by substantially planar first surface and substantially planar second surface, cases 22 will be well supported above spacers 30 and will not be able to sag to obscure airflow through airflow channels 38. Further, this consistent surface will provide excellent conduction of heat energy between the product contained within cases 22 and spacers 30. Generally, a metal will be used to form the top plate and bottom plate of spacers 30. To avoid the potential of cases 22 sticking to first surface 32 and second surface 34, the plates forming these surface may be coated with a non-stick material such as polytetrafluorethylene (PTFE), such as Teflon® sold by DuPont. In an alternative configuration a single use non-stick coating of, e.g., vegetable oil may be applied to substantially planar first surface 32 and substantially planar second surface 34.

Figure 11:
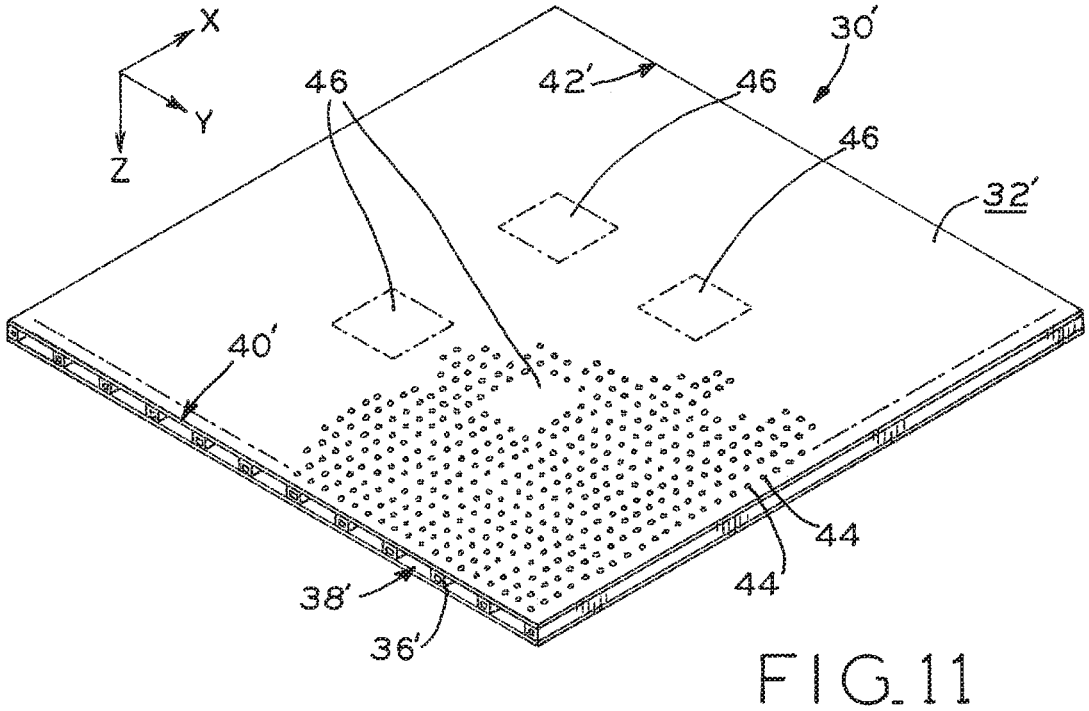
FIG. 11 is a perspective view of an alternative embodiment spacer in accordance with the present disclosure.

In certain embodiments of the present disclosure, substantially planar first surface 32 and substantially planar second surface 34 include perforations 44, as illustrated in FIG. 11. In such an embodiment, heat transfer between spacers 30 and the product contained in cases 22 via forced convection will be increased, as airflow through air channels 38 will traverse perforations 44 and thereafter encounter cases 22. Further, using a perforated plate to define first surface 32 and second surface 34 of spacer 30 decreases the cost of spacer 30. In certain embodiments, perforations 44 will be limited to an individual size that is small enough to prevent droop of cases 22 into perforations 44. In certain embodiments of the present disclosure, perforations 44 could account for removal of 90% of the material of the upper or lower plate in question that would otherwise (i.e., in the absence of the perforations) be encompassed by the outer perimeter of spacer 30.

Figure 12:
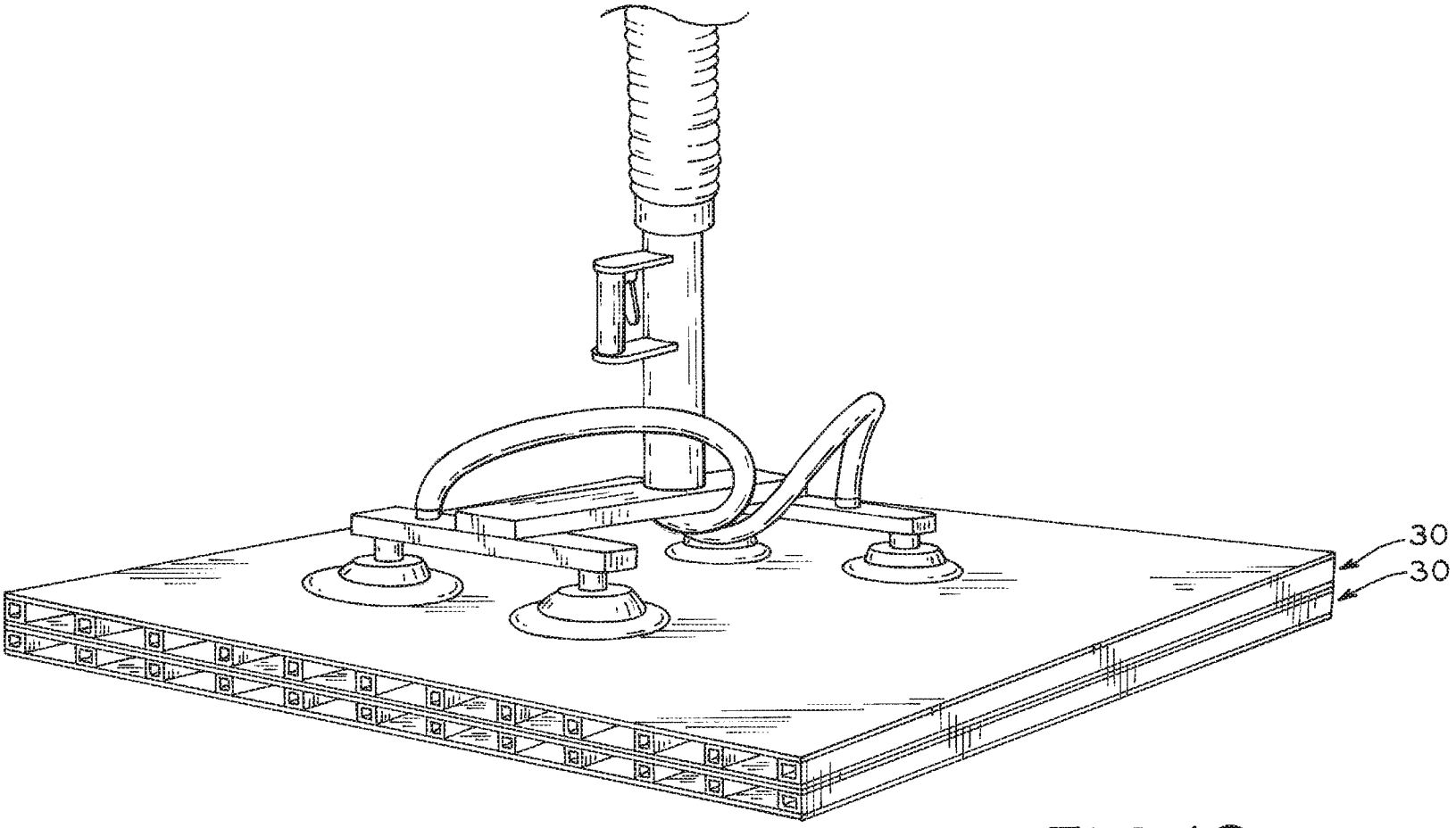
FIG. 12 is a perspective view illustrating a stack of a plurality of the spacers illustrated in FIG. 10, with an automated suction lifting device being utilized to remove and transport one of the spacers.

In an embodiment employing perforations 44, suction gripping surfaces 46 defining continuous surfaces free of perforations 44 sized to receive a suction gripping device, as illustrated, e.g., in FIG. 12 may be provided. In certain embodiments, suction gripping surfaces 46 may be sized to receive a suction cup having an outer diameter of 2 inches. To accommodate this size suction cup, the continuous surfaces free of perforations 44 may include any polygonal structure large enough to contain a 2 inch circle. Therefore, the area of such surfaces free of perforations 44 will be at least 3.2 inches and will likely be four square inches (a two inch by two inch square) or higher.

As described above, spacer 30 may be formed of a 14 gauge aluminum. Spacer 30 may also be formed of a 304 stainless steel material in a 14 gauge or smaller size. Mild steels may also be utilized to form spacers 30. In the embodiment illustrated in FIGS. 9, 10, 12 and 15, supports 36 are spaced from each other by about 4 to 6 inches measured along the x-axis of the Cartesian coordinate system illustrated, e.g., in FIGS. 10 and 11. Further, supports can be approximately 0.25 to 3 inches high as measured along the z-axis of the Cartesian coordinate system illustrated, e.g. in FIG. 10. In embodiments in which supports 36 comprise open ended tubing, such as the box tubing illustrated in FIGS. 10, 12, and 13-15, supports 36 comprise further airflow channels through their length because of their open ended tubular nature.

Figure 13:
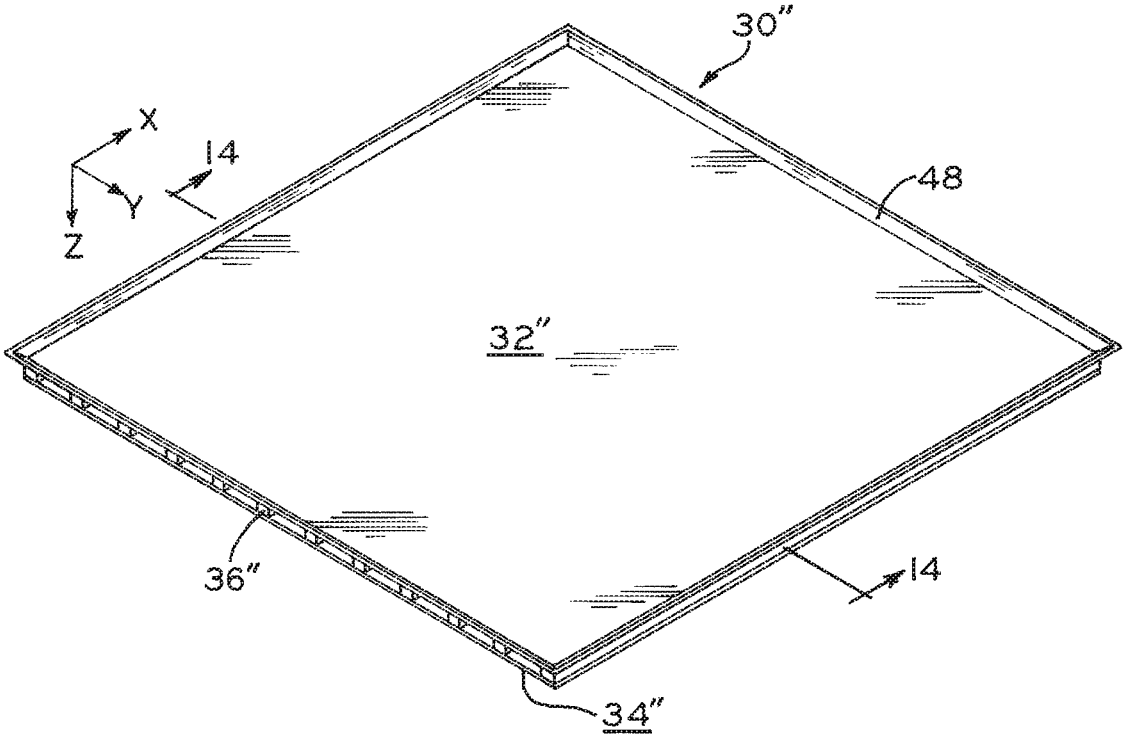
FIG. 13 is a perspective view of an alternative embodiment spacer in accordance with the present disclosure.
Figure 14:
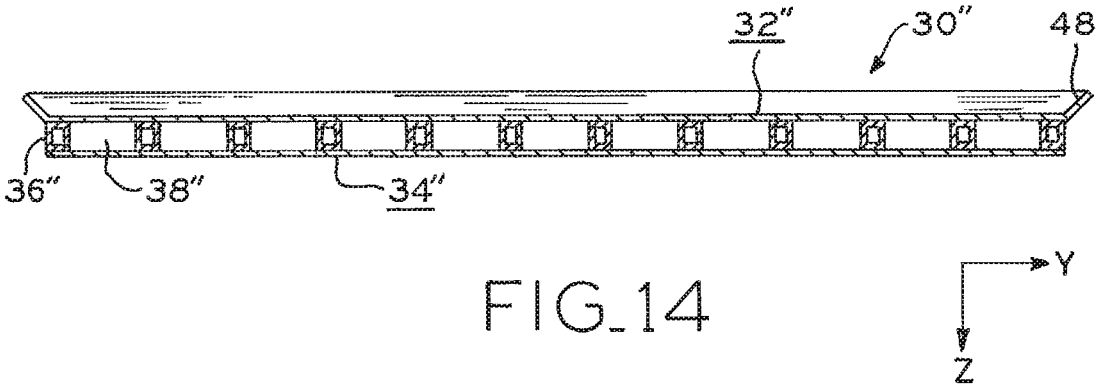
FIG. 14 is a sectional view of the spacer of FIG. 13 taken along line 14-14.
Figure 15:
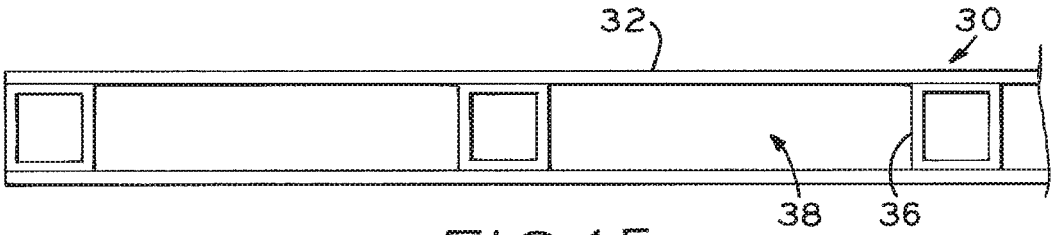
FIG. 15 is a partial, end view of the spacer illustrated in FIG. 10.

In the alternative embodiment illustrated in FIGS. 13 and 14, spacer 30 incorporates lip 48 extending upwardly from substantially planar first surface 32 and surrounding the perimeter of first surface 32 to hold any purge or liquid that is lost, e.g., when spacers 30 are used to thaw the product contained within cases 22. Spacers 30 of the present disclosure may define load capacities of, e.g., 1800 or 3600 pounds. Where spacer 30 has overall support surface dimensions of 40-42 inches by 48 inches as described above, this load capacity equates to as little as 128 or 135 pounds per square foot of support surface area, or as much as 257 or 270 pounds per square foot of support surface area. Moreover, it is contemplated that the support capacity of spacer 30 per square foot of support surface area may be designed to have any value within any range defined by any of the foregoing nominal values.

Figure 16:
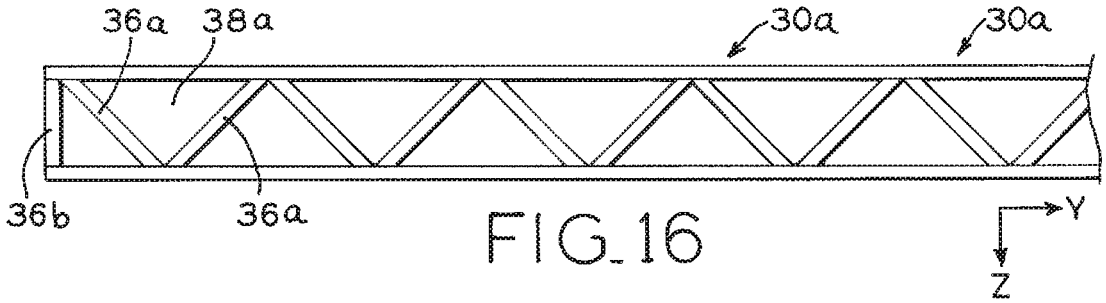
FIG. 16 is a partial, end view of an alternative embodiment spacer in accordance with the present disclosure.
Figure 17:
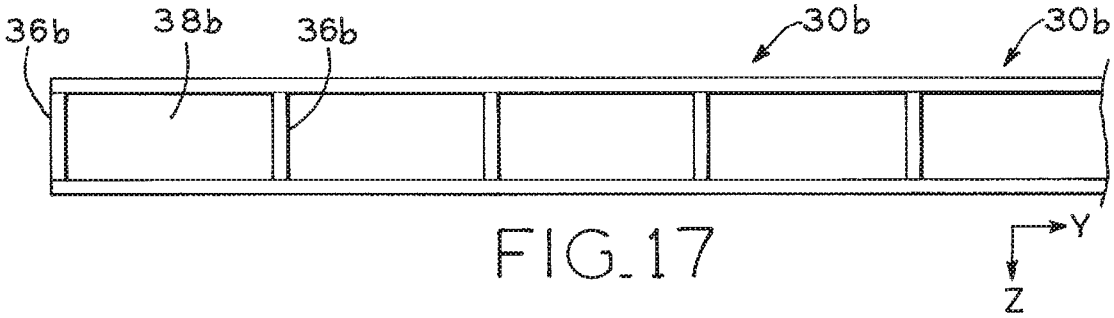
FIG. 17 is an end view of yet another alternative embodiment spacer in accordance with the present disclosure.
Figure 18:
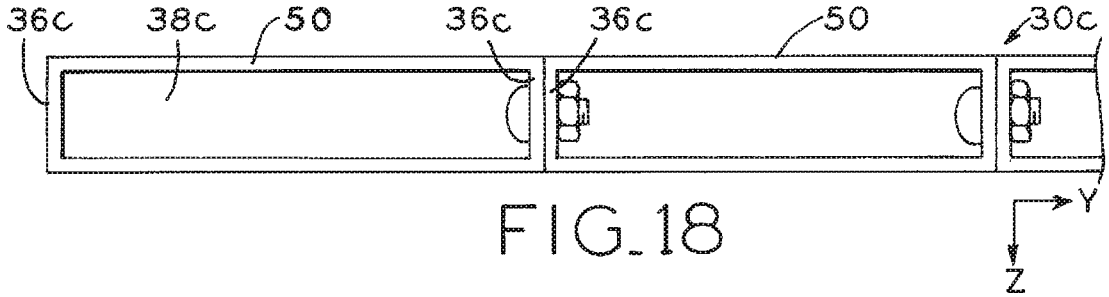
FIG. 18 is a partial, end view of a further alternative embodiment spacer in accordance with the present disclosure.

FIGS. 16-18 illustrate alternative spacers 30*a*, 30*b*, and 30*c* utilizing different supports 36A, 36B and 36C or some combination thereof. As illustrated in FIG. 16, supports 36A extend at an angle in the y-z plane and define triangularly shaped airflow channels 38A therebetween. The configuration illustrated in FIG. 17 includes vertically positioned supports 36B which extend along the z-axis to create airflow channels 38B. Vertically extending supports 36B may also be utilized at the ends of spacer 30A as illustrated in FIG. 16. Supports 36A and 36B may be secured in place by, e.g., welding and may be formed of the same material, including the same gauge of material as the plates forming substantially planar first surface 32 and substantially planar second surface 34 of spacer 30. FIG. 18 illustrates a further alternative embodiment incorporating supports 36C in the form of integral ends of open ended rectangular channel pieces 50, which may each be monolithically formed as a single unitary structure. As illustrated in FIG. 18, open ended rectangular channels 50 which define airflow channels 38C therethrough can be secured to one another by forming an aperture through adjacent supports 36C and securing adjacent open ended rectangular channels 50 to one another by inserting a bolt therethrough and fastening a nut in place as illustrated in FIG. 18. Any of the supports 36 contemplated by the present disclosure can have a height along the z-axis of about 0.25 to 3 inches. With respect to supports such as supports 36*a* which extend at an angle in the y-z plane, the height of such support is defined as the length it travels from one end to the other along the z-axis.

Figure 19:
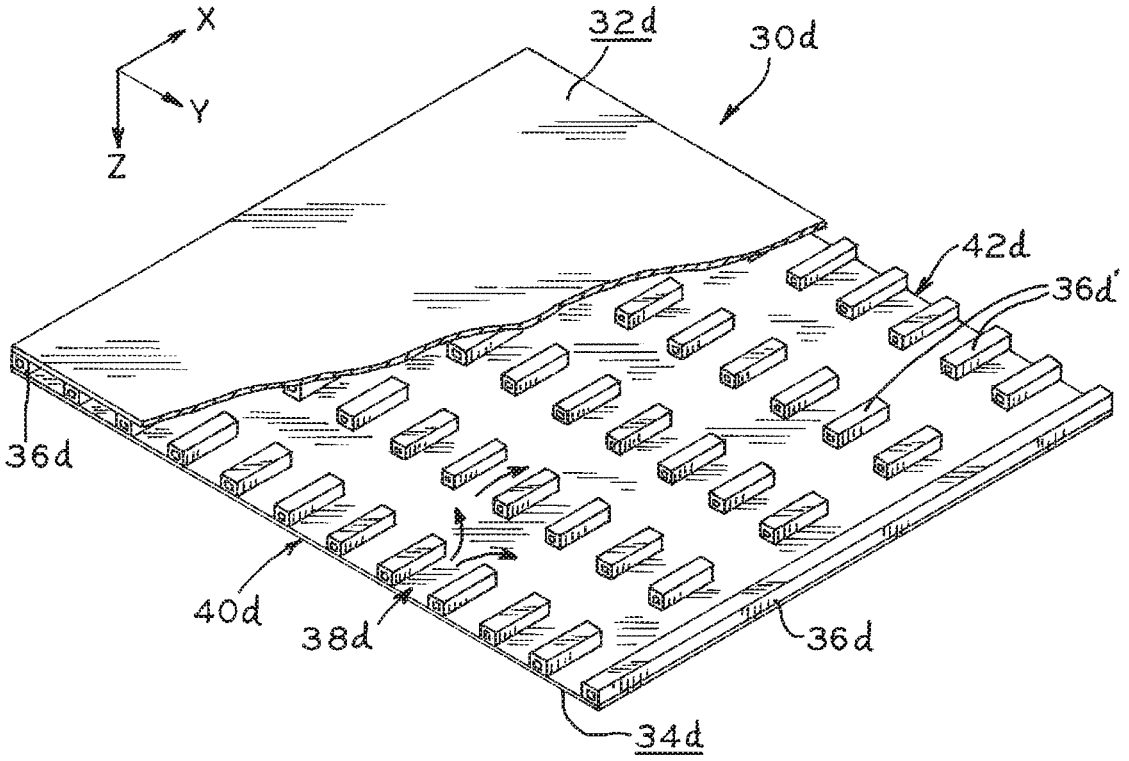
FIG. 19 is a partial perspective view of an additional alternative embodiment spacer in accordance with the present disclosure.

FIG. 19 illustrates another exemplary spacer 30*d*. Spacer 30*d* includes a single airflow channel 38*d* extending between airflow inlet side 40*d* and airflow outlet side 42*d*. Specifically, airflow channel 38*d* is formed between supports 36*d*, which are formed at the edges of the plates defining substantially planar first surface 32*d* and substantially planar second surface 34*d* that span airflow inlet side 40*d* and airflow outlet side 42*d*. Stated another way, supports 36 are aligned along the x-axis of the Cartesian coordinate system illustrated in FIG. 19 and are secured to both of the plates forming substantially planar first surface 32*d* and substantially planar second surface 34*d* along their entire length along the x-axis at their extremities along the y-axis. Supports 36*d* are the only supports of spacer 30*d* that span the entire x-axis length of the plates forming substantially planar first surface 32*d* and substantially planar second surface 34*d*. The remaining supports 36*d*' run less than the entire x-axis length of the upper and lower plates and provide mechanical support for the opposing plates, but do not define airflow channels from airflow inlet side 40*d* to airflow outlet side 42*d*. Supports 36*d*' are shown being oriented parallel to the x-axis; however, supports 36*d*' could be positioned in any desired orientation to provide mechanical support for the opposing plates. Supports 36*d* are sufficient to eliminate airflow from exiting the sides of spacer 30*d* spanning airflow inlet side 40*d* and airflow outlet side 42*d*. Any of the various supports of the present invention may be utilized in an embodiment similar to the one presented in FIG. 19. Specifically, any of the supports may replace box tube support 36*d* running the entire length of the sides of spacer 30*d* and any of the supports may be truncated to provide mechanical support at desired locations and orientations throughout the body of a spacer.

Various exemplary spacers of the present invention and their corresponding parts are denoted with primed reference numerals and/or reference numerals including an alphabetic designator such that similar parts of the various embodiments of spacer 30 include the same numeric reference. Any of the features described with respect to any of the various embodiments of spacer 30 described above may be utilized in conjunction with any other feature of any of the alternative embodiment spacers described in the present application.

2. Waveform Palletized Product Spacer.

Figure 20:
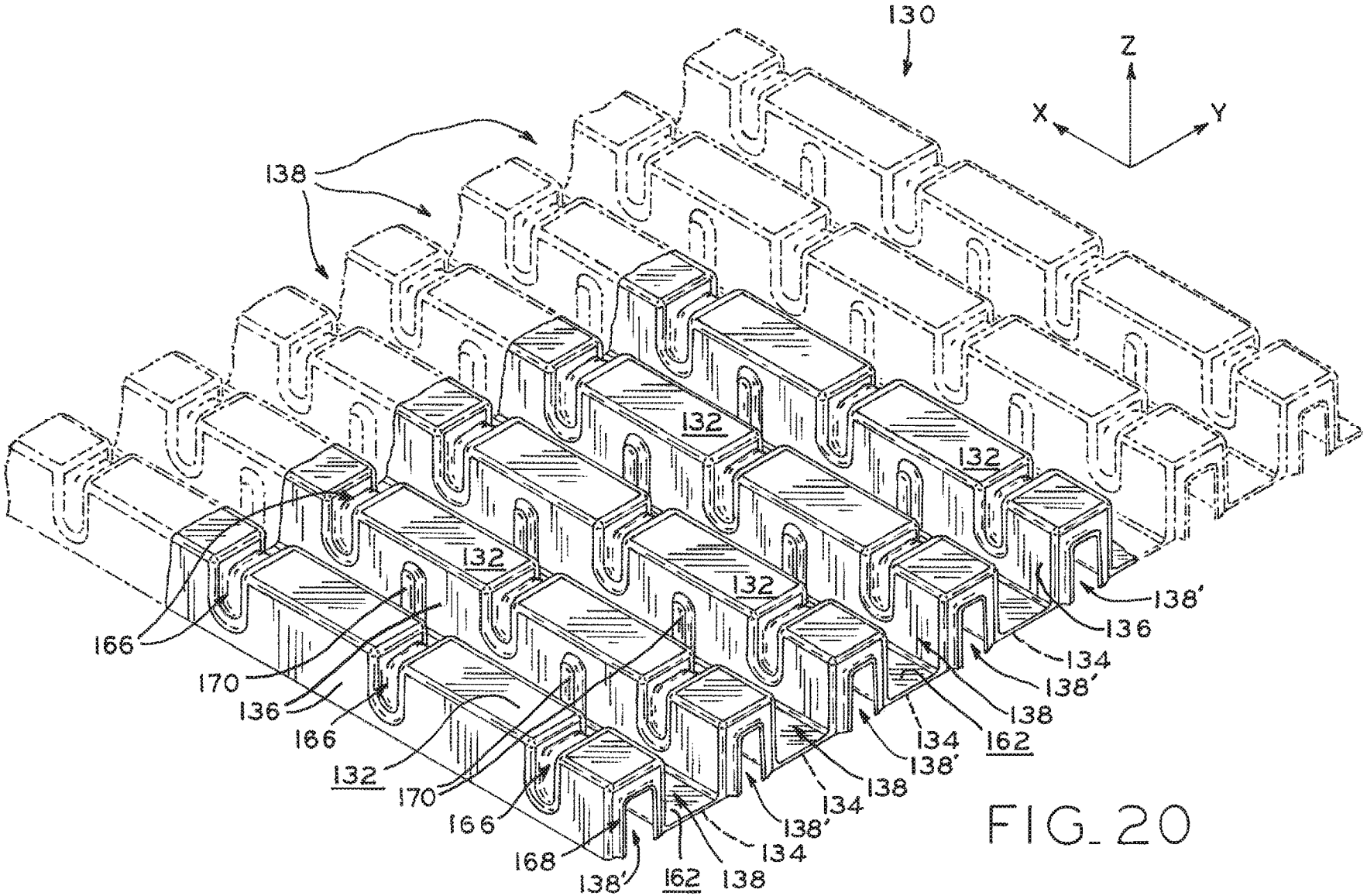
FIG. 20 is a partial perspective view of yet another alternative embodiment spacer in accordance with the present disclosure.
Figure 20A:
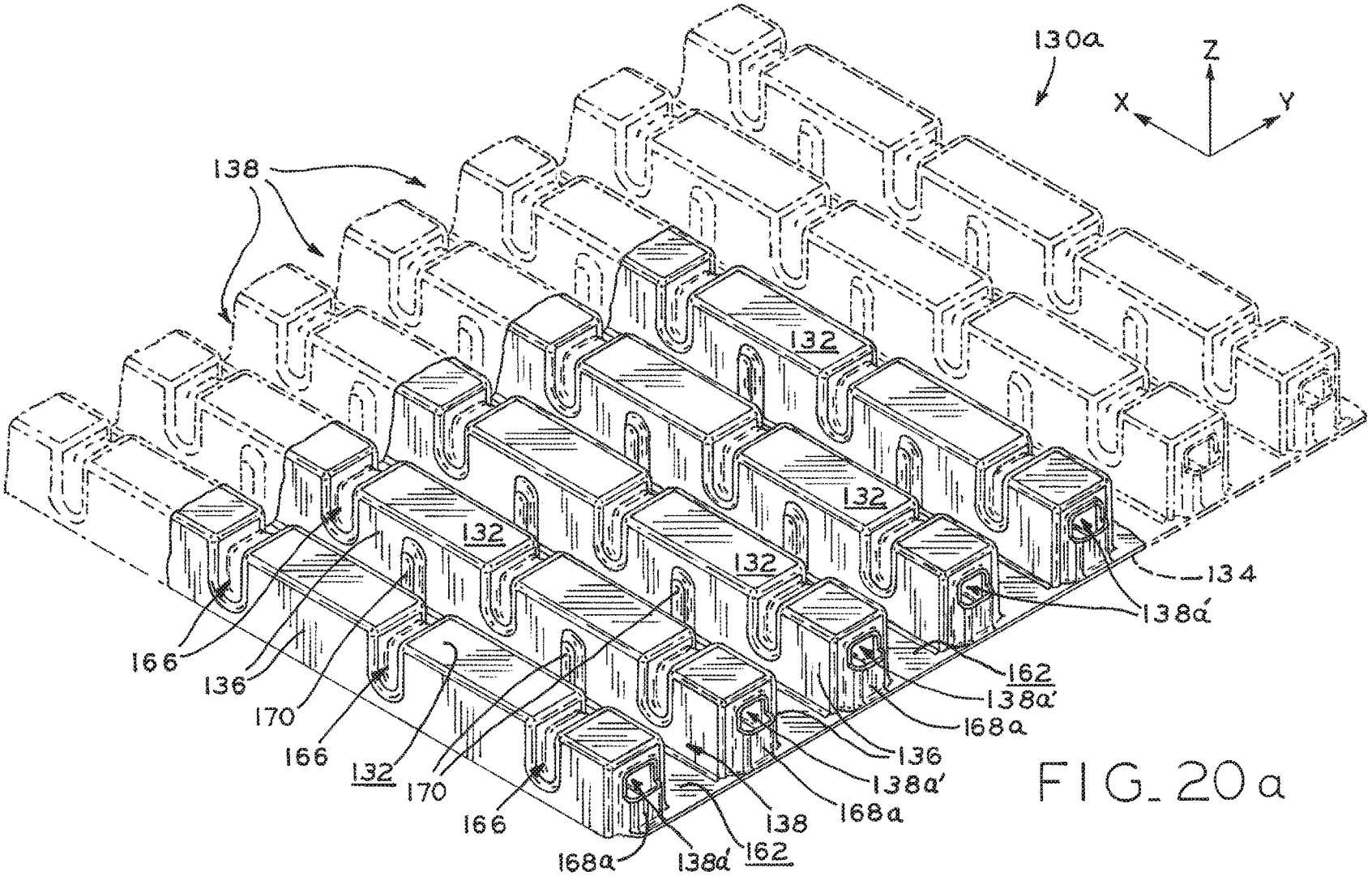
FIG. 20*a* is a partial perspective view of still another alternative embodiment spacer similar to the spacer of FIG. 21, in which another alternative end stiffener design is used.

Turning now to FIG. 20, another exemplary design for a palletized product spacer is illustrated. Spacer 130 includes airflow channels 138 and 138' which, like air pathways 24 of spacer 30 described in detail above, facilitate airflow along the x-direction of the illustrated Cartesian coordinate system while preventing any substantial airflow outside of channels 138, 138' in the y-direction. Generally speaking, structures of spacer 130 are denoted by reference numerals which correspond to the reference numerals of analogous structures of spacer 30, except with 100 added thereto. Moreover, spacers 30, 130 are generally interchangeable when used to vertically space apart respective rows of cases 22 in pallet assembly 52 (see, e.g., FIG. 9).

Spacer 130 includes a plurality of substantially planar, upper support surfaces 132 which extend in an x-y plane of the illustrated Cartesian coordinate system (FIG. 20). Upper support surfaces 132 can be said to be elongate, as each surface 132 has a longitudinal extent along the x-direction that is substantially larger, such as 10-20 times larger, than the corresponding width of surface 132 along the y-direction. For purposes of the present disclosure, small interruptions in the longitudinal extent of surfaces 132, such as by stiffener ribs 166 described in further detail below, is not considered to disrupt the overall longitudinal shape of surfaces 132, which run from an inlet of airflow channels 138, 138' at one side of spacer 130, to an outlet thereof at the other side of spacer 130.

Interposed between respective neighboring pairs of upper support surfaces 132 are substantially planar, elongate lower support surfaces 134 vertically spaced from upper support surfaces 132 (i.e., along the z-direction) by a total vertical distance corresponding to the overall height H (FIG. 21) of spacer 130. In an exemplary embodiment, vertical height H may be about 1.5 inches, which is large enough to provide substantial airflow through airflow channels 138, 138', while remaining small enough to maximize the number of rows of cases 22 which can be stacked upon pallet 4 (FIG. 26) for a given height of pallet assembly 52. However, it is contemplated that height H may be as small as 0.5 inches, 1.0 inch, or 1.5 inches, or as large as 2.5 inches, 3.0 inches or 3.5 inches, or maybe any height within any range defined by any of the foregoing values.

Figure 26:
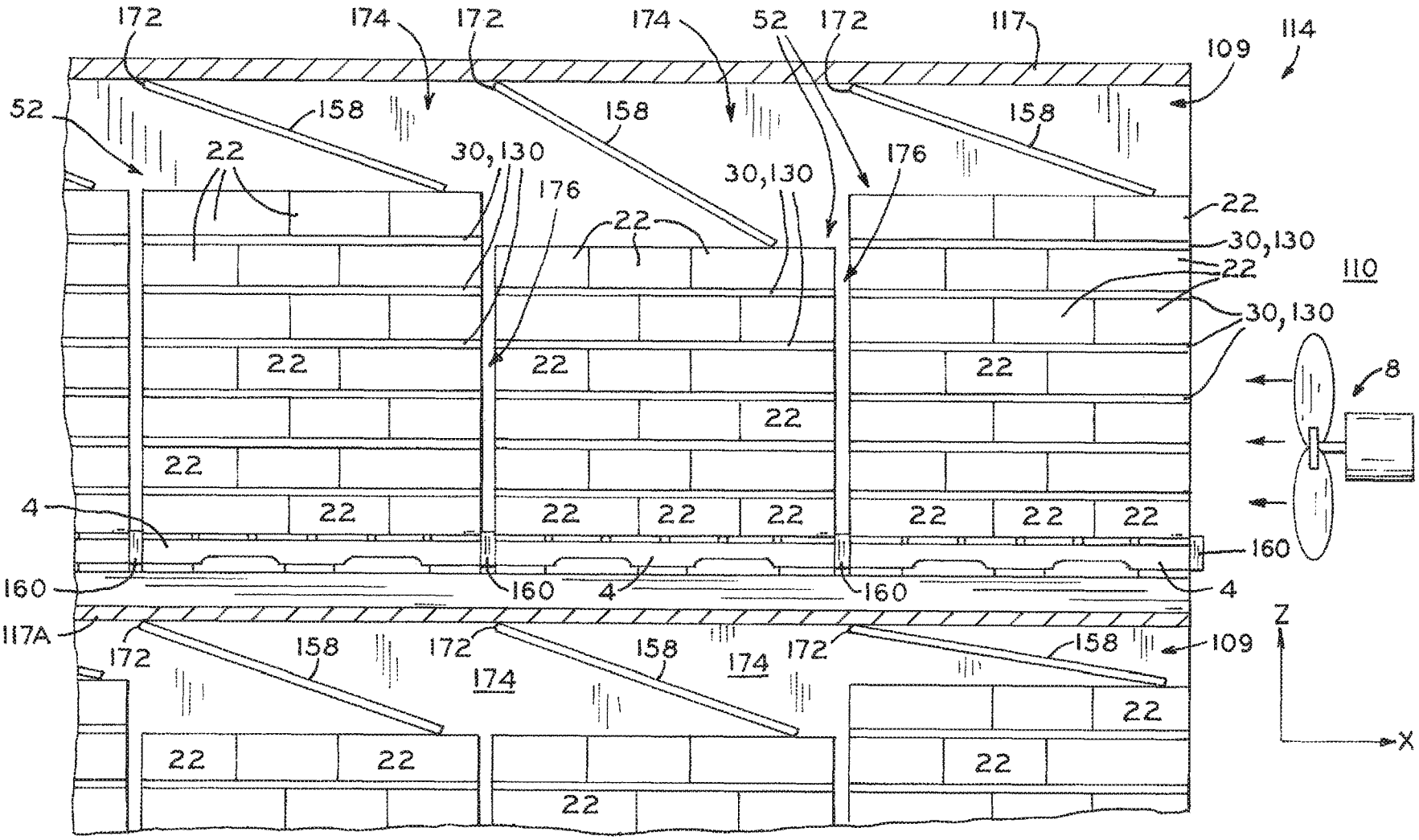
FIG. 26 is an elevation view of a portion of the racking structure shown in FIG. 25, illustrating detail thereof.

Connecting respective upper support surfaces 132 to their adjacent, neighboring lower support surfaces 134 are sidewalls 136. In one exemplary embodiment, sidewalls 136 are substantially vertical to provide columnar support for the compressive loads applied between upper and lower support surfaces 132, 134 when spacer 130 is used in pallet assembly 52 (as shown in FIG. 26 and described further below). In exemplary embodiments, spacer 130 is formed from a single, unitary, monolithic material. Exemplary materials include polymers such as acrylonitrile butadiene styrene (ABS), polyester copolymer (PETG), polystyrene (PS), polycarbonate (PC), polypropylene (PP), sheet or foamed-sheet polyethylene (PE), polyvinyl chloride (PVC) and acrylic (PMMA). In order to facilitate mass-production of spacer 130 by molding techniques (e.g., vacuum forming, injection molding, foam forming, etc.), and to facilitate storage and shipping of groups of spacers 130 in a stacked and nested configuration, sidewalls 136 may be slightly angled such that any neighboring pair of sidewalls 136 diverge toward the open end of the respective airflow channel 138 or 138' formed by the neighboring pair of sidewalls 136. This divergence provides a "draft" which facilitates production of spacer 130 by injection molding (e.g., by allowing hold halves to be removed without binding to sidewalls 136). The draft also allows respective upper support surfaces 132 to be received within airflow channels 138', and lower support surfaces 134 to be received within airflow channels 138, so that spacers 130 can be nested with one another into large stacks that are efficiently and compactly transportable. In one exemplary embodiment, the draft angle of each sidewall 136 with respect to vertical (i.e., with respect to the z-direction) may be between 0.5 and 3 degrees, such as about 1 degree.

Airflow channels 138 each have a cross-sectional area bounded in the y-direction by the distance between sidewalls 136, and in the z-direction by lower surface 162 of airflow channel 138 and the x-y plane defined by upper support surfaces 132. As described in further detail below, thickness T of the material of spacer 130 may cooperate with the overall geometry and structure of airflow channels 138, 138' to maximize these distances, and thereby maximize the cross-sectional area available within airflow channels 138, 138'. A large cross-sectional area provides for large airflow rate potential through channels 138, 138' and facilitates a correspondingly large rate of thermal transfer when spacer 130 is used as a product spacer in a warehouse environment, e.g., a blast freezer.

The cross-sectional area of airflow channels 138' is similarly bounded by sidewalls 136 along the y-direction, and by upper surface 164 (FIG. 24) of channel 138' and the x-y plane defined by lower support surfaces 134 in the z-direction. However, as further described below, end stiffeners 168 and intermediate stiffeners 166 (FIG. 20) may slightly reduce the overall available cross-sectional area available for airflow channel 138'. This reduction imparts additional compressive strength to spacer 130 to increase the load-carrying capacity of spacer 130, while also promoting air-side (i.e., upstream) turbulence without significantly reducing air flow. This turbulence may assist with the heat transfer capacity of the airflow, while the directional airflow itself maintains air movement across the entire extent of pallet assembly 52. Similarly, lower stiffeners 170 may protrude slightly into airflow channels 138 but also provide impart compressive strength to spacer 130. In an exemplary embodiment, stiffeners 166, 168 and 170 consume no more than 40% of the theoretical maximum airflow area through channels 138, 138' respectively. In other exemplary embodiments, this area may be less than 30%, 20%, 15% or 10%, for example.

Figure 21:
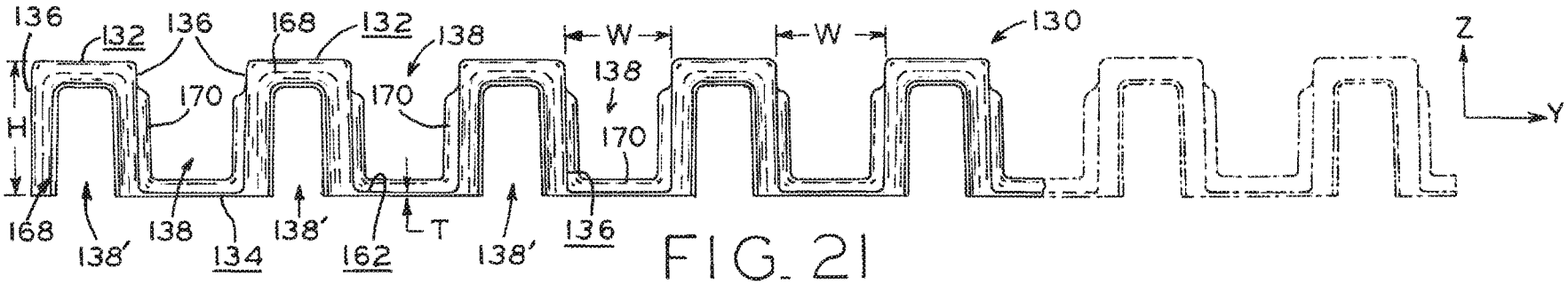
FIG. 21 is a front elevation view of the spacer shown in FIG. 20, it being understood that a rear elevation view thereof is identical.
Figure 22:
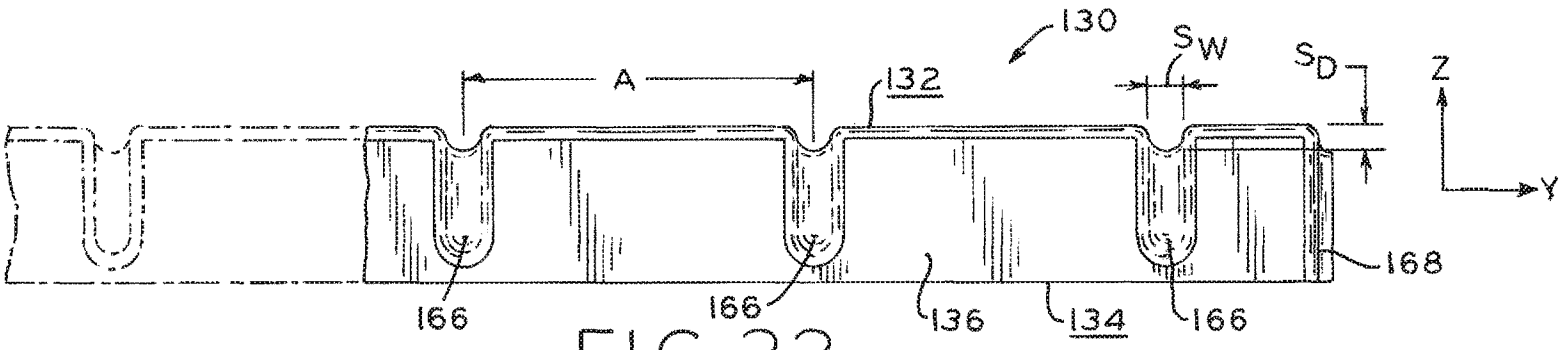
FIG. 22 is a left side elevation view of the spacer shown in FIG. 20, it being understood that the right side elevation view thereof is identical.

As best seen in FIG. 21, the arrangement of upper and lower support surfaces 132, 134 and sidewalls 136 creates an undulating, waveform-like profile of lands and valleys, in which the lands (i.e., flattened peaks) are formed by respective upper support surfaces 132, and the valleys are formed as airflow channels 138 between each neighboring pair of upper support surfaces 132. This arrangement allows direct convective thermal transfer from the bottom surface of the case disposed upon upper support surfaces 132, as airflow passes through airflow channel 138 along a longitudinal path extending in the x-direction (as further described with respect to airflow management below). Similarly, convective thermal transfer can occur between the upper surface of a case upon which lower support surfaces 134 of spacer 130 rest, as air flows through airflow channels 138' along the x-direction. In an exemplary embodiment, airflow channels 138, 138' are all substantially linear, in that channels 138, 138' define longitudinal axes that extend along a substantially straight line (i.e., nominally straight) in the x-direction. In addition, airflow channels 138, 138' all define longitudinal extents in the x-direction that are substantially parallel (i.e., nominally parallel), which simplifies the logistics of air handling (i.e., by handlers 8 and exhaust fans 12 as described herein).

In addition to this high potential for heat transfer provided by spacer 130, the planar support surface area of upper and lower support surfaces 132, 134 may each equal up to half of the overall coverage area of spacer 130, where the "coverage area" is the total area in the x-y plane potentially overlaid by spacer 130. This large support surface area provides substantial support for the adjacent surfaces of case 22 resting upon surfaces 132, 134, and is enabled by orienting sidewalls 136 in vertical or near vertical orientation (e.g., a planar orientation aligned or nearly aligned with an x-z plane). Thus, if spacer 130 defines an overall width in the y-direction of 48 inches and an overall depth in the x-direction of 40 inches (i.e., the standard width and depth of a pallet), upper support surfaces 132 may cumulatively total up to half of the coverage area of 1,920 square inches (i.e., the surface area covered by spacer 130), or up to 960 square inches. However, in some exemplary embodiments, the cumulative support surface area of upper support surfaces 132 is slightly less than 50% in view of less-than-vertical sidewalls 136 (as discussed above), and/or interruptions in individual longitudinal upper support surfaces 132.

Figure 24:
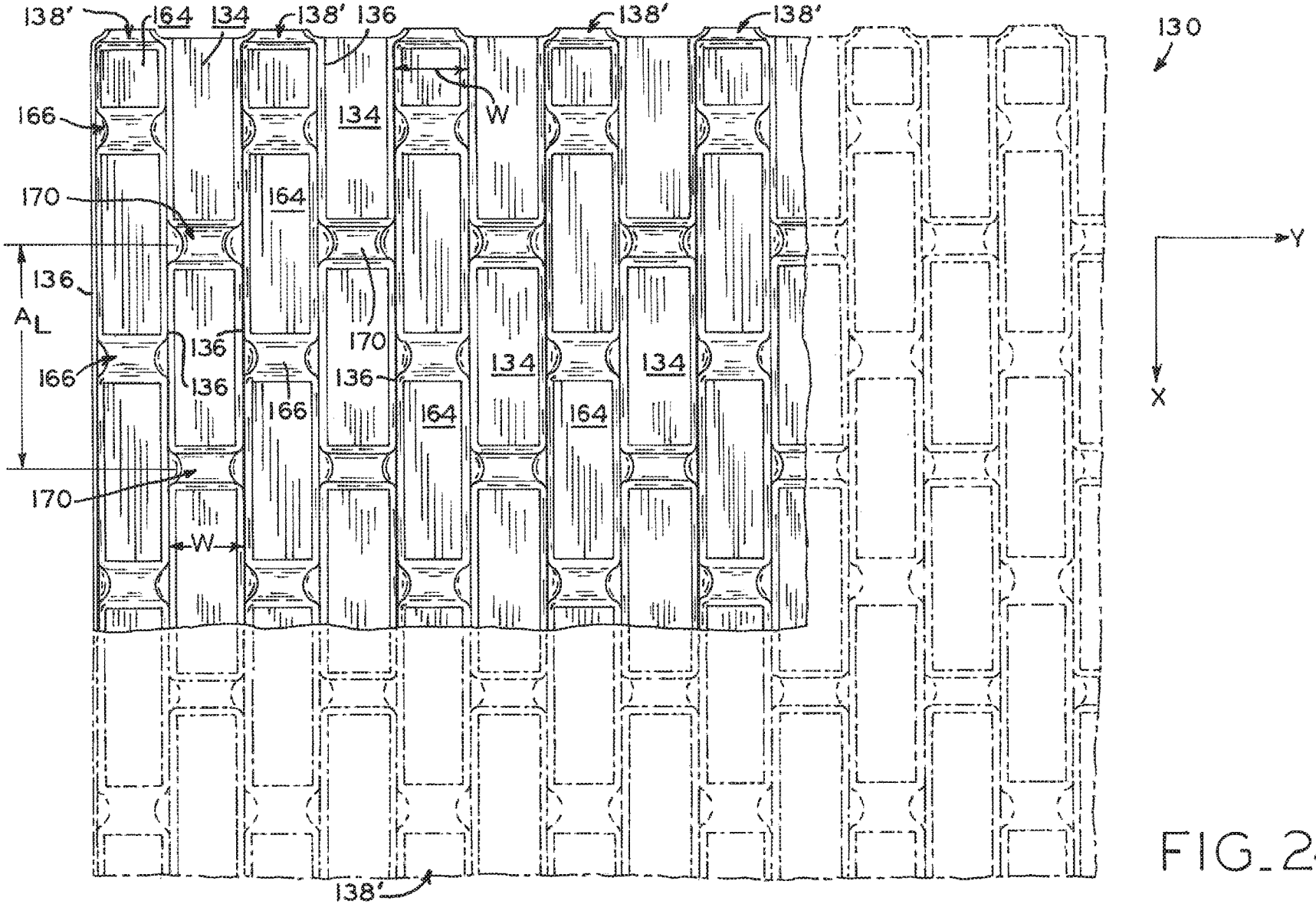
FIG. 24 is a bottom plan view of the spacer shown in FIG. 20.
Figure 24A:
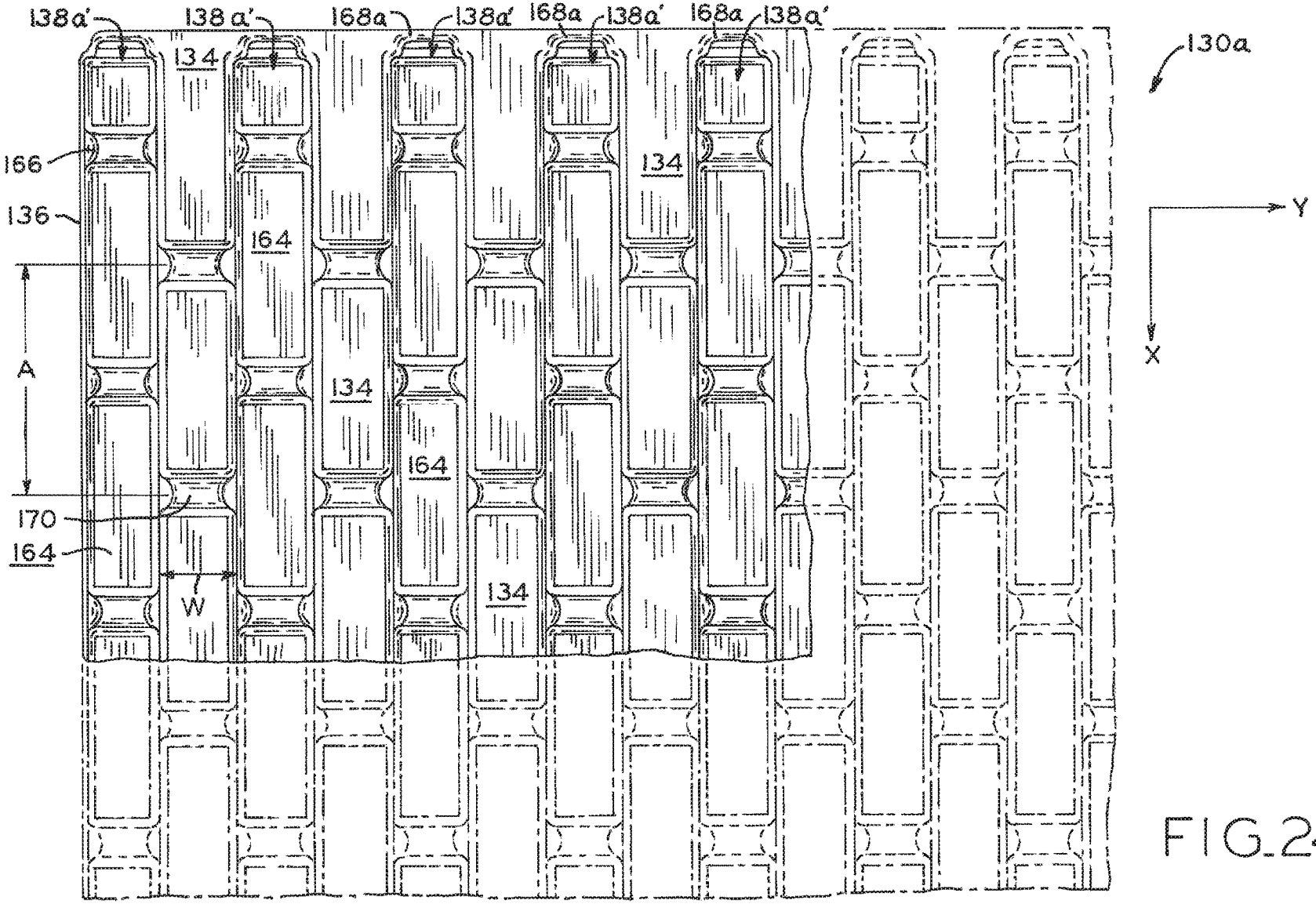
FIG. 24*a* is a bottom plan view of the spacer shown in FIG. 20*a*.

For example, as best seen in FIG. 20, intermediate stiffeners 166 may interrupt respective upper support surfaces 132 along the longitudinal extent thereof (i.e., along the x-direction), slightly reducing the cumulative support surface area of upper support surfaces 132. As further described below, intermediate stiffeners 166 may occupy up to 15% of the area of upper support surfaces 132, and therefore up to 7.5% of the total surface area covered by spacer 130. However, even if sidewalls 136 include a draft angle and intermediate stiffeners 166 are provided, upper support surfaces 132 of spacer 130 directly abuts and support cases 22 over at least 40% of the overall coverage area of spacer 130 (FIG. 26). Lower support surfaces 134 are similarly arranged, and may be interrupted by lower stiffeners 170 (FIGS. 21 and 24). Therefore, the cumulative abutting support area of lower support surfaces 134 is also at least 40%, and up to 50%, of the overall coverage area of spacer 130. By contrast, "egg carton" type predicate spacers 20 (shown in FIG. 7 and described above) have a comparable contact area of 25% or less.

The large amount of coverage area provided by upper and lower support surfaces 132, 134 provides support to prevent cases 22 from sagging or otherwise protruding into airflow channels 138, 138', thereby maintaining the channels' large cross-sectional airflow area. The overall width W along the y-direction of airflow channels 138, 138' may also be controlled to prevent such sagging, as well as providing a sufficient number of "lands and valleys" (described above) to provide high mechanical strength of spacer 130. In an exemplary embodiment, width W of airflow channels 138, 138' is about 1 inch, which is small enough to avoid sagging of a typical cardboard case 22 into airflow channels 138, 138' but also large enough to promote substantial airflow. Thus, if the associated width of the adjacent upper and lower surfaces 132, 134 are commensurate with width W (i.e., the lands and valleys of spacer 130 have equal widths along they direction), a spacer 130 having an overall width of 48 inches may have about 25 lands and 24 valleys, while a 40-inch-wide spacer 130 may have about 21 lands and 20 valleys. In these embodiments, one additional land (formed by upper support surface 132) may be provided to ensure that end stiffeners 168 (further described below) are present at both terminal ends of spacer 130. In other embodiments, it is contemplated that width W of airflow channels 138, 138' may be as small as 0.5 inches, 1.0 inch or 1.5 inches or may be as large as 2.0 inches, 2.25 inches, or 2.5 inches, or maybe any width within any range defined by any of the foregoing values.

In addition to the substantial support surface area provided by the undulating lands and valleys of spacer 130, additional shapes and structures of spacer 130 may cooperate to impart substantial compressive mechanical strength to mitigate or prevent loss of overall height H due to buckling when cases 22 are stacked upon upper support surfaces 132. In some embodiments, a desired mechanical strength of spacer 130 may be accomplished by using rigid materials, such as aluminum, to form spacer 130, and/or by increasing material thickness T to provide material-based compressive strength. However, production efficiency, weight and cost considerations militate against the use of heavy and/or large quantities of material in forming spacer 130. In order to reduce overall material usage and enable the use of materials with less inherent strength, spacer 130 may include end stiffeners 168, intermediate stiffeners 166, lower stiffeners 170, or any combination thereof.

Generally speaking, stiffeners 166, 168, 170 interconnect neighboring pairs of sidewalls 136 with the adjacent upper support surface 132 or lower support surface 134 disposed therebetween. This interconnection is accomplished by introducing one or more stiffener walls disposed in the y-z plane, as best illustrated in FIG. 20. For example, end stiffeners 168 form a partial closure of airflow channels 138' (FIG. 20) and thereby interconnect a neighboring pair of sidewalls 136 with the upper support surface 132 between the pair of sidewalls 136. When a compressive stress is applied to upper surface 132, the tendency of sidewalls 136 to splay apart or otherwise deform at the junction between sidewalls 136 and upper surface 132 introduces a tensile stress into the material of end stiffener 168. Where spacer 130 is made of a material with high tensile strength, such as some polymers and especially cross-linked polymers, the shifting of this tensile stress into the material of end stiffener 168 counteracts the tendency of sidewalls 136 to splay apart, thereby creating a rigid or semi-rigid barrier against such splaying and preserving the integrity of the lands-and-valleys shape of spacer 130.

Similarly, intermediate stiffeners 166 form indented portions of sidewalls 136 and upper surface 132 which protrude slightly into airflow channel 138'. These indented portions, in effect, create a pair of sidewall-like structures extending in the y-z plane and stiffen the adjacent sidewalls 136 in the same manner as end stiffeners 168. In an exemplary embodiment, shown in FIG. 2, intermediate stiffeners 166 have a semi-circular profile defining a stiffener depth SD of about 0.25 inches and a stiffener width Sw of about 0.25 inches (such that the semi-circular profile has a diameter of about 0.25 inches). This nominal depth and width is sufficient to impart substantial additional strength to spacer 130 while minimizing the interruption to upper support surfaces 132 and sidewalls 136. In an exemplary embodiment, end stiffeners 168 may protrude into channels 138' by an amount equal to, or less than, the protrusion formed by intermediate stiffeners 166.

This exemplary protrusion geometry may leave the cross-sectional area of the respective channels 138' substantially uninterrupted, e.g., by occupying less than about 20% of the overall height of channel 138', where the height of channel 138' is the distance along the z-direction between upper surface 164 of channel 138' and the x-y plane defined by lower support surfaces 134 as shown in FIG. 24 and noted above. Width W is similarly unobstructed by stiffeners 166 and/or stiffeners 168, which occupy less than about 20% of channel 138'. Channel 138 is substantially uninterrupted by lower stiffeners 170 in a similar fashion. In addition, this minimal protrusion into sidewalls 136, as described above, minimizes or substantially prevents lateral escape of air from channels 138 and 138', instead ensuring that such airflow will be directed entirely or nearly entirely along the x-direction.

In addition, stiffeners 166 may be distributed at regular intervals across the longitudinal extent of upper support surfaces 132 by a spacing or amplitude A. The nominal value of amplitude A may be chosen such that intermediate stiffener 166 repeats often enough to impart the desired strength to spacer 130, without unduly interrupting the otherwise large support surface area provided by upper support surfaces 132. In an exemplary embodiment, amplitude A is about 3 inches, which when combined with the 0.25 inch values for depth SD and width Sw, preserves at least 85% of the available cumulative support surface area of upper support surfaces 132 available for direct abutment with a lower surface of case 22 (FIG. 26). In other embodiments, amplitude A may be as little as 1 inch, 2 inches or 4 inches, or as large as 6 inches, 7 inches or 8 inches, or may be any value within any range defined by any of the foregoing values. Similarly, width Sw may be varied in proportion to amplitude A, such that width Sw is as little as ⅛ inch, ⅜ inch or ½ inch, or as large as ¾ inch, ⅞ inch or 1 inch, or any value within any range defined by any of the foregoing values.

Figure 20B:
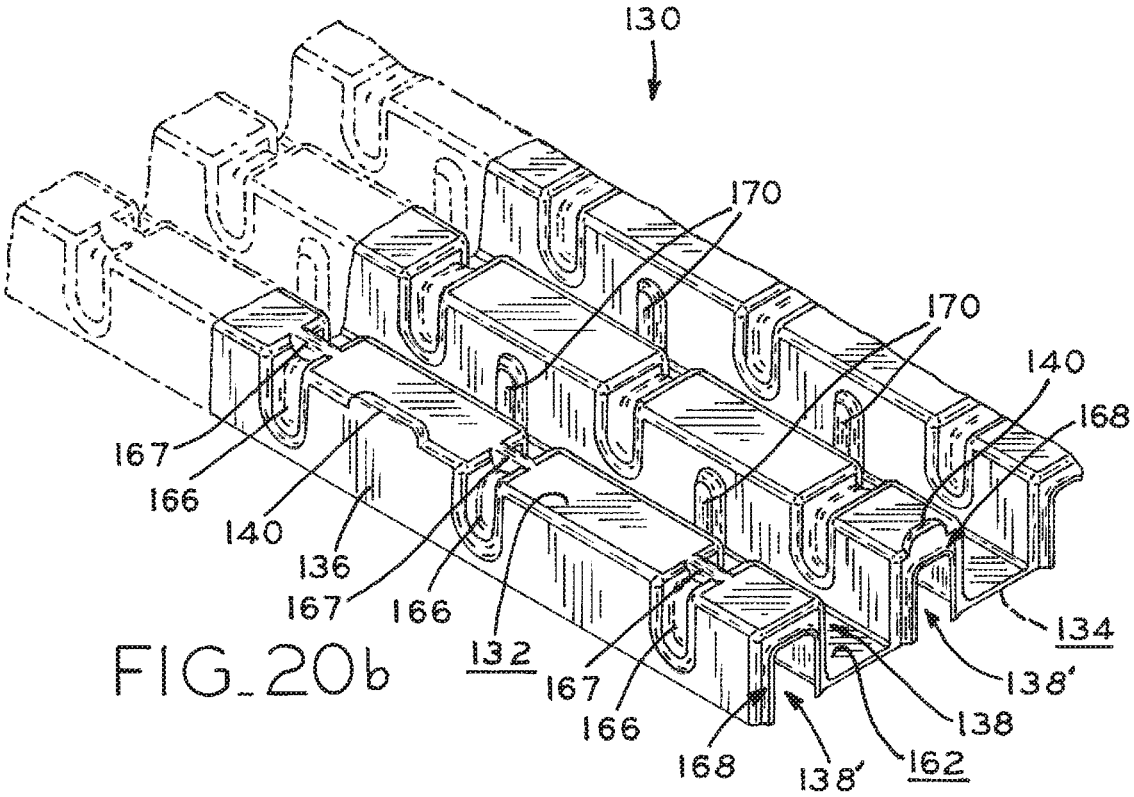
FIG. 20*b* is a partial perspective view of a portion of the spacer shown in FIG. 20, illustrating an optional secondary stiffener.

Turning to FIG. 20*b*, secondary intermediate stiffeners 167 may optionally be provided within intermediate stiffeners 166. In the illustrated embodiment, secondary intermediate stiffeners 167 are located along an outermost upper support surface 132 of spacer 130, so as to provide additional stiffening support along the edges of spacer 130 where higher pressures may be concentrated as a result of relatively stiff sidewalls of cases 22. Stiffeners 167, as shown, extend transversely to stiffeners 166 and generally along the longitudinal extent of upper surface 132. Although stiffeners 167 are shown only along upper support surfaces 132 disposed along the lateral edge of spacer 130, it is also contemplated that stiffeners 167 could be provided throughout stiffeners 166 as required or desired for additional strength. Of course, given that only one corner of spacer 130 is shown in FIG. 20*b*, it is contemplated that the corresponding upper support surfaces 132 of spacer 130 along the opposite edge (not shown) may also have stiffeners 167. In addition, although stiffeners 167 are shown and described as an optional feature of spacer 130, stiffeners 167 may be similarly applied to spacer 130*a* shown in FIGS. 20*a*-24*a*.

In addition, the barrier to lateral airflow (i.e., in the y-direction) posed by sidewalls 136 is left substantially uninterrupted by the small amount of lateral area interrupted by intermediate stiffeners 166. In the illustrated exemplary embodiment, this interruption represents less than 2% of the total potential barrier area of each sidewall 136 (i.e., the barrier area that would exist without stiffeners 166), while in other exemplary embodiments the interruption may represent less than 5% of the total potential barrier area.

Lower stiffeners 170 are the same or substantially the same as intermediate stiffeners 166, except lower stiffeners 170 protrude upwardly into channels 138 and form an indented portion in lower support surfaces 134 and its adjacent sidewalls 136. In the exemplary embodiment shown in FIG. 20, lower stiffeners 170 are disposed between neighboring pairs of intermediate stiffeners 166 along the x-direction so as to provide additional strengthening of spacer 130 where it is needed most, i.e., halfway between the two neighboring intermediate stiffeners 166. Thus, in the exemplary embodiment of FIG. 20, lower stiffeners 170 define amplitude $A_L$ equal to amplitude A, e.g., about three inches (FIG. 24).

In an exemplary embodiment, end stiffeners 168 are provided at respective longitudinal ends of downwardly opening airflow channels 138', but not at corresponding respective longitudinal ends of upwardly opening airflow channels 138. Because palletized products (such as meat or other food products) tend to settle to the bottoms of their respective cases 22, the lower surface of cases 22 is a primary target for maximum heat transfer capability during a blast freezing operation. Accordingly, spacer 130 is designed to facilitate maximum airflows through the upwardly-opening airflow channels 138, which allows substantial direct air contact with the adjacent lower surface of case 22. Such maximum airflows are provided by unencumbering airflow passage through channels 138 as much as practicable. Thus, while lower stiffeners 170 may be provided for additional mechanical strength along and between lower support surfaces 134 and the adjacent sidewalls 136, end stiffeners 168 may be omitted to enhance airflow through channels 138.

As noted above, in an exemplary embodiment, spacer 130 is formed as a single monolithic structure. This monolithic structure may include stiffeners 166, 168 and/or 170, as illustrated in FIG. 20. When stiffeners 166, 168 and 170 are all included in the monolithic structure, and spacer 130 is made of a monolithic polymer material having a thickness T (FIG. 21) of 0.060 inches, empirical testing has demonstrated that the compressive mechanical strength of spacer 130 is sufficient to preserve at least 95% of the overall height H of spacer 130 under a load of at least 270 pounds per square foot. This strength is sufficient to support up to seven layers of 60-pound cases of product within pallet assembly 52, with ten such cases contained in each 40-inch-by-48-inch layer of cases 22 (as shown in FIG. 26). Thus, it has been empirically determined that an exemplary embodiment of spacer 130 can be expected to maintain large and substantially fully open airflow channels 138, 138' between adjacent layers of stacked cases 22 within pallet assembly 52, including between the bottom two layers of cases 22. As described in further detail below, this open airflow channel provided by spacer 130 facilitates heat transfer in a blast freezing operation, while also being producible in high volume at a low unit cost. Spacers 130 are also lightweight for their strength, e.g., less than 0.5 pounds per square foot of surface area support.

In addition, maintaining thickness T at 0.060 inches (which may be uniform throughout the material of spacer 130) and spacer height H at 1.5 inches, a channel height up to 1.44 inches is produced for airflow channels 138, 138'. Thus, the airflow channel height of spacer 130 is at least 95% of overall height H, thereby maximizing airflow passage potential for a given spacer size.

In an alternative embodiment, spacer 130*a* may be provided as shown in FIGS. 20*a*, 21*a*, 22*a*, 23*a* and 24*a*. Spacer 130*a* is identical to spacer 130, except airflow channels 138*a*' include polygonal (e.g., substantially rectangular) apertures formed in end stiffeners 168*a* rather than the substantially completely open channels 138' shown in FIG. 21. All features of spacer 130 described herein are applicable to spacer 130*a*, and spacers 130 and 130*a* are interchangeable in use. Channels 138*a*' allow for longitudinal air flow in similar fashion to channels 138' described in detail above. Except for the air flow area opened by the apertures admitting air to channels 138*a*', end stiffeners 168*a* respectively form a continuous wall as illustrated. Spacer 130*a* may be manufactured with airflow channels 138*a* initially closed, i.e., end stiffeners 168*a* may respectively form walls completely blocking airflow access to the various channels 138*a*'. In order to open the rectangular aperture as illustrated, material may be selectively removed from end stiffener 168*a* after the molding of spacer 130*a* is completed, such as with an end mill or other suitable cutting tool. This allows for mass production of spacer 130*a* with a continuous end wall at end stiffener 168*a*, which may have an appropriate draft angle and material thickness to facilitate efficient production by injection molding. In addition, the material of end stiffeners 168*a*, which spans neighboring sidewalls 136 across the bottom of channels 138*a*' as illustrated, provides additional stiffness and compressive strength to spacer 130*a*. More particularly, the continuity of material across the bottom of channel 138*a*' serves as a "tension strap" between neighboring sidewalls 136 to provide extra security against splaying or bowing of sidewalls 136 under a heavy compressive load on upper support surfaces 132.

Figure 21B:
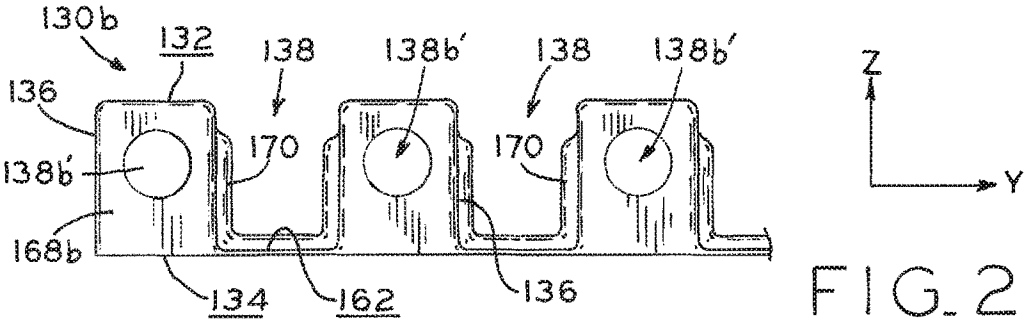
FIG. 21*b* is a front elevation, partial view of an alternative spacer similar to the spacer of FIG. 21, in which yet another alternative end stiffener design is used.
Figure 21A:
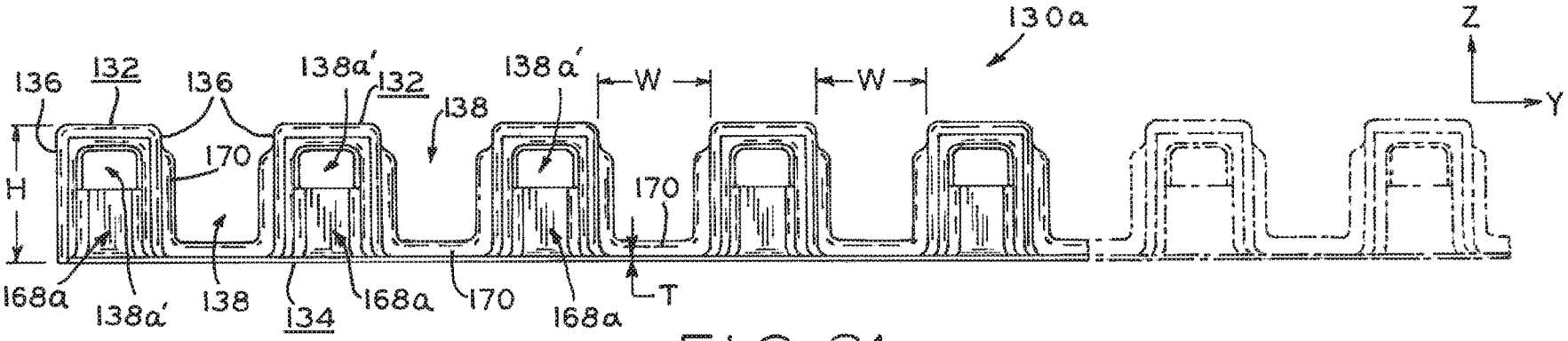
FIG. 21*a* is a front elevation view of the spacer shown in FIG. 20*a*, it being understood that a rear elevation view thereof is identical.
Figure 22A:
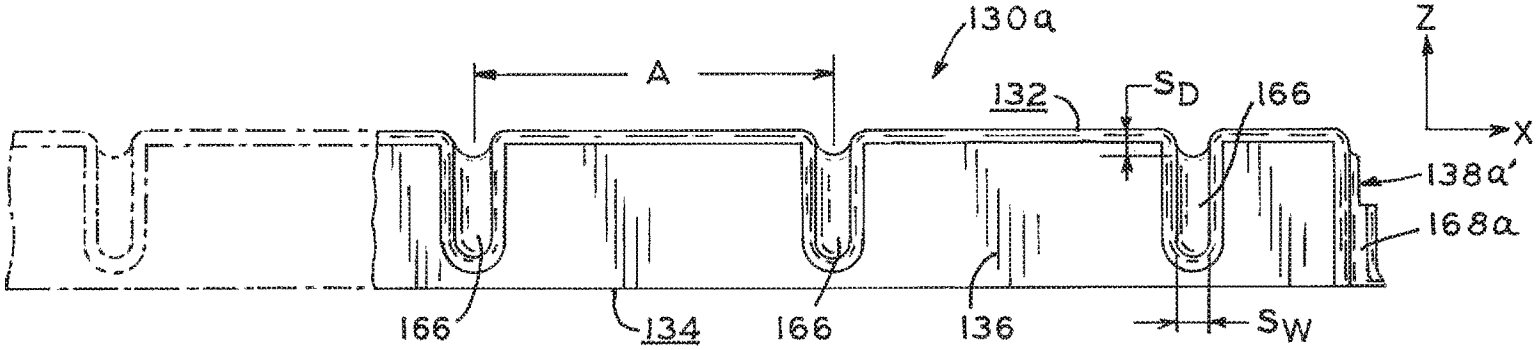
FIG. 22*a* is a left side elevation view of the spacer shown in FIG. 20*a*, it being understood that the right side elevation view thereof is identical.
Figure 23:
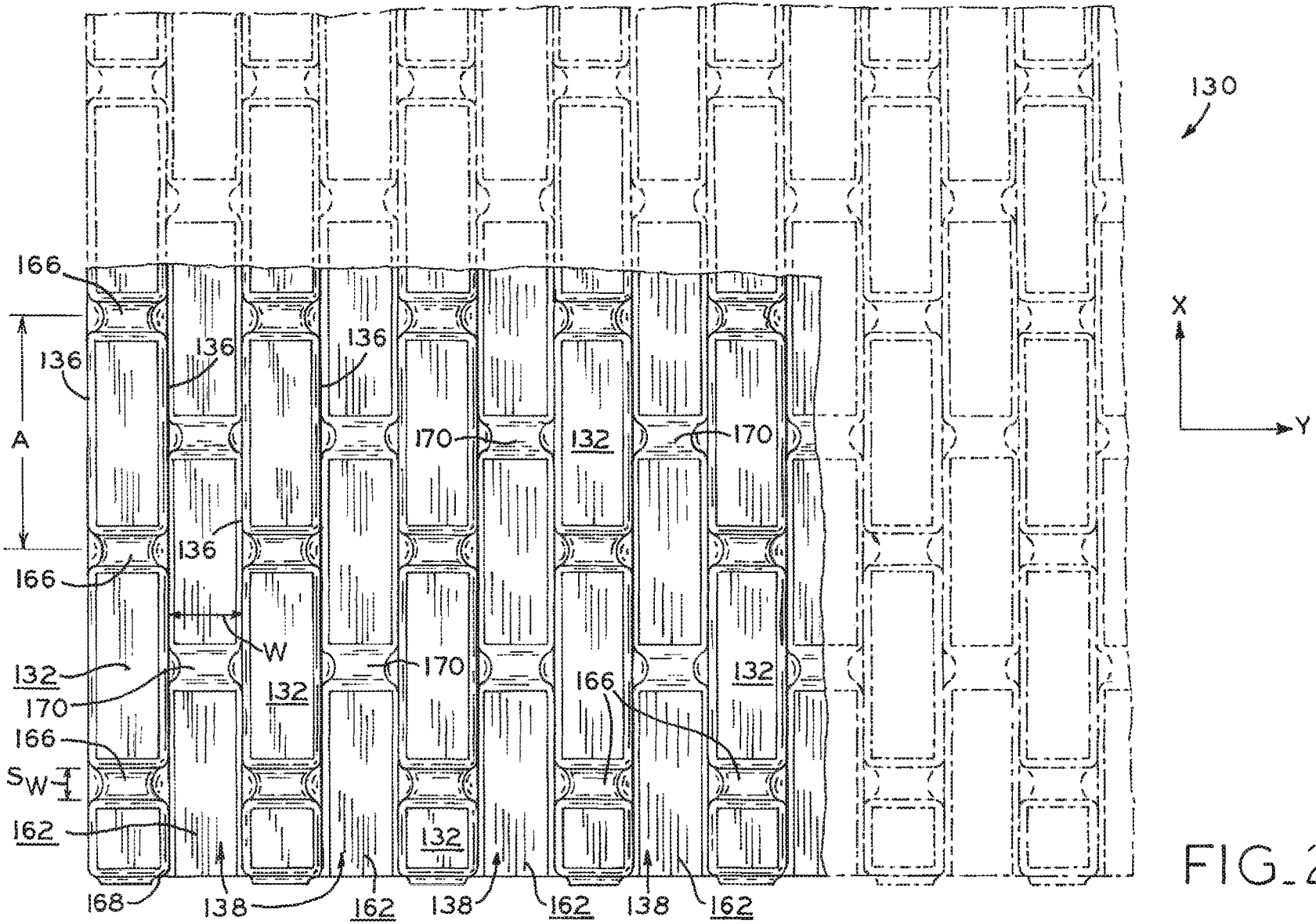
FIG. 23 is a top plan view of the spacer shown in FIG. 20.
Figure 23A:
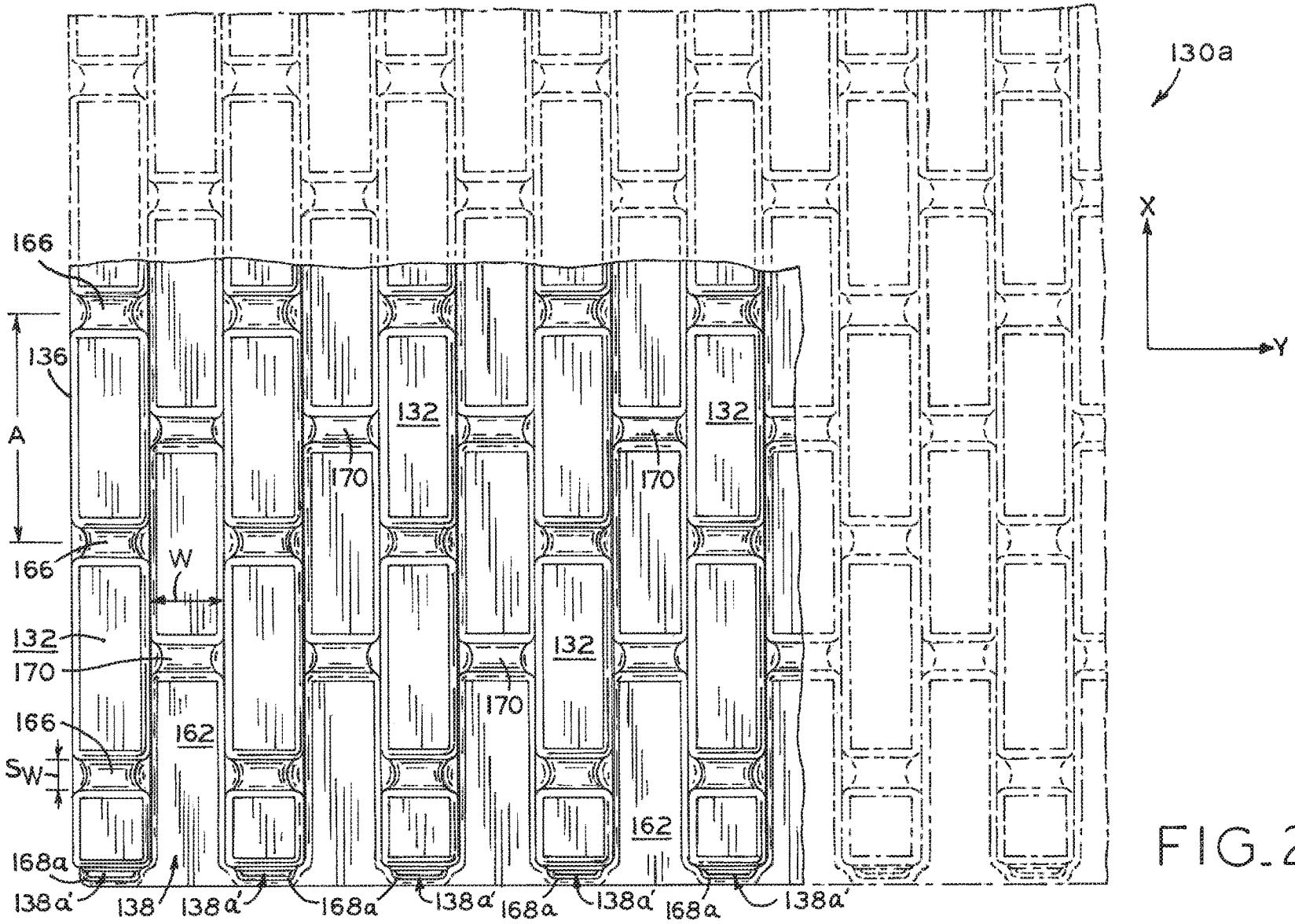
FIG. 23*a* is a top plan view of the spacer shown in FIG. 20*a;*

In another alternative embodiment, spacer 130*b* may be provided as shown in FIG. 21*b*. Spacer 130*b* is identical to spacer 130, except airflow channels 138*b*' include arcuate (e.g., round) holes formed in end stiffeners 168*b* rather than the substantially completely open channels 138' shown in FIG. 21 or the rectangular channels 138*a*'. All features of spacer 130 may be equally applied to spacer 130*b*, and spacers 130 and 130*b* are interchangeable in use except as otherwise provided herein. Channels 138*b*' allow for airflow in similar fashion to channels 138' described in detail above. Except for the air flow area opened by holes 138*b*', end stiffeners 168*b* form a continuous wall as illustrated, thus providing additional compressive strength to spacer 130*b* in a similar fashion to spacer 130*a* above.

As noted above, spacers 130 may be sized to completely overlay a 40-inch-by-48-inch pallet. In some embodiments, channels 138, 138' may be oriented along the 40-inch direction, and in other embodiments, channels 138, 138' may be oriented along the 48-inch direction depending on the requirements of a particular application. In addition, spacer 130 may be slightly oversized, such as 42-inches-by-50-inches, in order to allow some "overhang" or protrusion of spacer 130 past the edges of respective layers of cases 22, such that any overhang of the edges of cases 22 is prevented from restricting or reducing air flow through channels 138, 138'.

Figure 25:
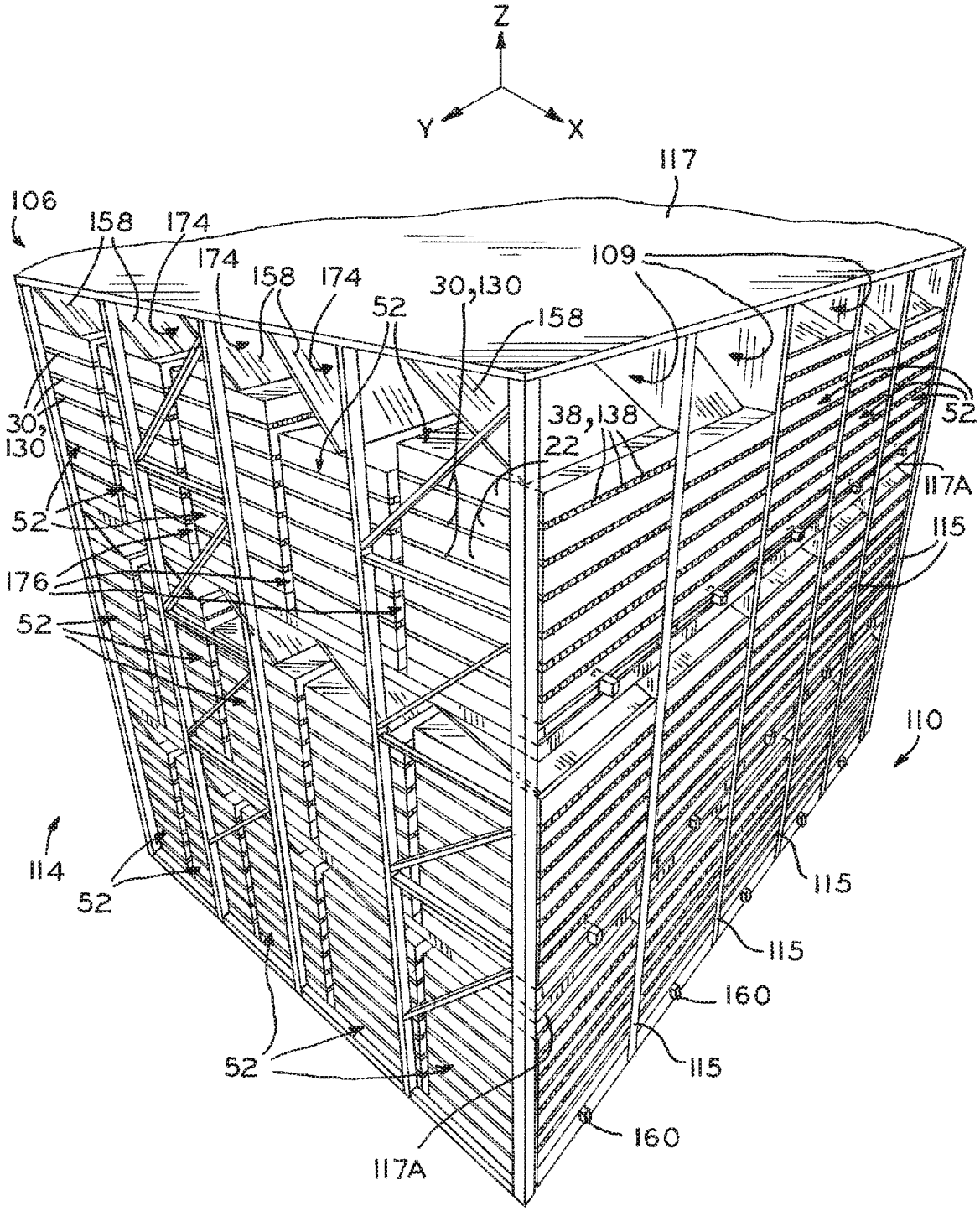
FIG. 25 is a perspective view of a warehouse racking structure in accordance with the present disclosure, in which multiple pallet assemblies are disposed in a single deep racking bay to define upstream and downstream pallet assemblies relative to the directional airflow utilized by an air handling system.

Turning again to FIG. 20*b*, case stabilizers 140 may optionally be provided as part of the monolithic structure of spacer 130, as illustrated. As illustrated, case stabilizers 140 are formed at the terminal ends of spacer 130, i.e., along sidewall 136 at the edge of spacer 130 and/or at end stiffener 168. Case stabilizers 140 protrude upwardly away from support surface(s) 132 such that cases 22 received upon spacer 130 (as shown in FIGS. 25 and 26) are prevented from sliding or shifting past the edge of spacer 130. Thus, case stabilizers 140 serve to retain cases 22 in their intended positions, fully supported by the various underlying support surfaces 132, and to prevent part of the spacer-contacting surfaces of cases 22 from sliding out of contact with support surfaces 132 during loading, transport and other handling of pallet assemblies 52.

3. Airflow Management Devices.

Turning now to FIG. 25, high-capacity racking 114 useable in warehouse 2 (FIGS. 1-3) is illustrated. As described above, racking 14 can include rows and columns of pallet assemblies 52 disposed between aisles 10 and air chambers 6, with exhaust fans 12 drawing air from respective aisles 10 through pallet assemblies 52 and into chambers 6 before exhausting the air back into the interior space of warehouse 2. However, as shown in FIGS. 3 and 4, these rows and columns of pallet assemblies 52 are arranged in bays designed for only one layer of depth for pallet assemblies 52 between aisles 10 and chambers 6.

By contrast, high-capacity racking 114 has bays 109 each designed to accept more than one pallet assembly 52 along the depth direction (i.e., along the x-direction of the illustrated Cartesian coordinate system). For purposes of the present disclosure, the "depth direction" corresponds to the intended direction of airflow between aisles 10 and chambers 6 (as shown in FIG. 4), which is also the longitudinal direction of airflow channels 38 and/or 138 of spacers 30, 130.

In the illustrated embodiment of FIG. 25, bays 109 are sufficiently deep to house five adjacent pallet assemblies 52 as illustrated. In an exemplary method of use, each pallet assembly 52 may be loaded from the back side of racking 114, i.e., from within chamber 106. As each pallet assembly 52 is inserted into a respective bay 109, the pallet assembly 52 may be drawn, e.g., by gravity, into abutting engagement with a front side of racking 114, i.e., the side facing aisle 110. Further pallet assemblies 52 are similarly loaded within bay 109 to fill bay 109 with up to four additional pallet assemblies 52 as illustrated in FIG. 25.

Racking system 114 can be used for highly efficient space utilization within warehouse 2, because the percentage of space occupied by aisles 110 and air chambers 106 represents a relatively smaller percentage of the total space within warehouse 2 while the space occupied by pallet assemblies 52 is a concomitantly larger percentage. On the other hand, the large "block" of pallet assemblies 52 contained within high-capacity racking 114 may be subject to the same requirements as racking 14 for consistent and efficient heat transfer for, e.g., a blast freezing operation. For example for palletized food products subject to food safety regulations and standards, predictability of freezing rates for each individual case 22 in a blast freezing operation is the same regardless of whether racking 14 or 114 is used within warehouse 2. To this end, racking 114 includes air management systems operable to ensure consistent airflow through spacers 30 and/or 130 along the entire depth of bays 109. In addition to spacers 30, 130, these systems may also include pivotable air dams 158 and lateral pallet spacers 160, both described in detail below.

Turning to FIG. 26, one pivoting air dam 158 is provided within bay 109 for each pallet assembly 52 received therein. Each air dam 158 is pivotally affixed to top panel 117 via pivots 172, which may take the form of a piano-type hinge, a plurality of door-type hinges, an elastomer hinge, or any other suitable hinging structure. As each pallet assembly 52 passes from its entry point within chamber 116 towards aisle 110 (FIG. 25), the upper layer of cases 22 on the pallet assembly 52 causes air dam 158 to pivot upwardly about pivot 172.

Air dam 158 is a substantially rigid structure, such as hard plastic (e.g., ABS), aluminum, steel or the like. The weight of air dam 158 maintains firm contact with the upper layer of cases 22 to maintain a fluid tight seal along the upper surface of pallet assembly 52, as shown, and this force of weight may be augmented by a spring bias or other biasing force as needed. In addition, a high pressure resulting from movement of air from air handler 8 forces air flowing past pallet assemblies 52 can also create a positive pressure differential on the upstream surface of each air dam 158, it being understood that the highest-pressure air will be located at air handlers 8 and downstream locations will have steadily reduced air pressures. This positive pressure differential may also tend to urge air dams 158 into firm contact with their respective pallet assemblies 52, thereby creating a substantially fluid-tight seal at the interface therebetween. Where air dams 158 are used with standard-sized pallet assemblies 52, air dams 158 may define a width of about 40 inches or about 48 inches to correspond with the associated pallet assembly 52 disposed below air dams 158. The overall height of air dams 158 may be any dimension suitable to a particular height variability of pallet assemblies 52, such as about 40 inches.

When the next pallet assembly 52 is loaded into bay 109, the next downstream air dam 158 similarly seals against the upper row of cases 22 and, in cooperation with the first (upstream) air dam 158, forms a fluid tight manifold space 174 in the head space bounded by neighboring upper surfaces of adjacent pallet assemblies 52, neighboring pairs of air dams 158, and top panel 117. The lateral sides of manifold space are sealed by sidewalls 115 (FIG. 25). In FIG. 25, one of sidewalls 115 is omitted to show the internal details of racking system 114, it being understood that such sidewalls 115 are provided on both lateral sides of manifold spaces 174 to preserve the fluid tight seal therein. Turning back to FIG. 26, the pivotable arrangement of air dams 158 allows pallet assemblies 52 of differing heights to be loaded into bay 109 while maintaining fluid tight manifold spaces 174. Finally, intermediate panels 117A provide a floor for bays 109 to seal manifold space 174 from below. Wiper seals (not shown) may also be included to seal any space that may exist between air dams 158 and the respective adjacent sidewalls 115.

Intermediate panels 117A also act as a ceiling for lower bays 109, as illustrated, where racking 114 has multiple rows of pallet assemblies 52. Sidewalls 115 may also provided between each column of bays 109, facilitating creation of individualized manifold spaces 174 in columns for each pallet assembly 52 contained in racking 114. In this way, bays 109 can be arranged in any desired number of rows and columns, similar to the arrangement of racking 14, except with multiple pallet assemblies along the depth dimension (i.e., along the x-direction) of bays 109 as noted above.

Lateral pallet spacers 160 are provided as part of pallet assembly 52 when used in high-capacity racking 114, in order to ensure that each manifold space 174 receives a consistent flow of air from air handlers 8. As best seen in FIG. 26, pallet spacer 160 protrudes outwardly from the periphery of each pallet 4 along the x-direction, such that when each pallet assembly 52 is loaded into bay 109, neighboring pairs of pallet assemblies 52 abut one another by contact between pallet spacer 160 and the next adjacent pallet 4. Cases 22 are also arranged to be within the footprint or profile of pallet 4, i.e., cases 22 do not overhang past the edges of pallet 4. In this way, layers of cases 22 on neighboring pallet assemblies 52 are prevented from abutting one another, such that an intra-pallet manifold space 176 is created and maintained between neighboring pairs of pallet assemblies 52. As illustrated in FIG. 26, manifold space 176 is in direct fluid communication with manifold space 174, such that air passing through spacers 30 and/or 130 of pallet assembly 52 exits the upstream pallet assembly 52 and flows into the first manifold spaces 174, 176, creating an elevated air pressure therein (as compared to the ambient air pressure within warehouse 2). This elevated air pressure drives the air through the next set of spacers 30, 130 in the adjacent downstream pallet assembly 52, exiting into the next downstream manifold space 174 and passing into space 176. The elevated air pressure propagates through all of the pallet assemblies 52 arranged along the depth of bay 109 in this way, finally exiting at the downstream-most outlet of spacers 30 and/or 130 of the furthest downstream pallet assembly 52, and into chamber 106 (FIG. 25) for exhaust back to warehouse 2. In this way, cooling airflow is ensured through spacers 30 and/or 130 of each and every one of the pallet assemblies 52 contained within high-capacity racking 114, and therefore around the upper and lower surfaces of each and every case 22 contained therein.

Figure 27:
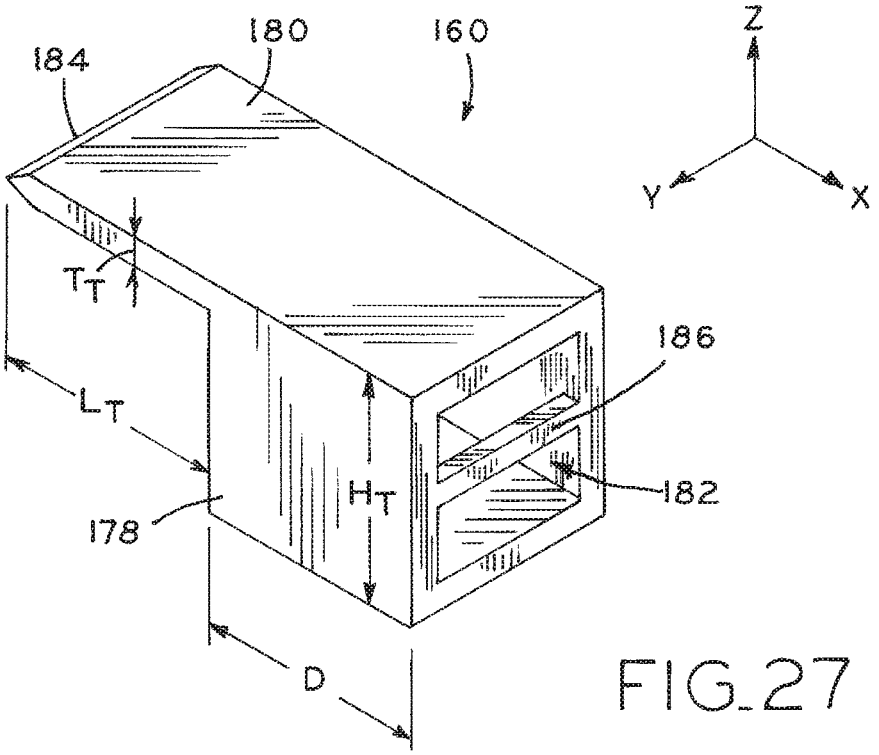
FIG. 27 is a perspective view of a lateral pallet spacer in accordance with the present disclosure.

One exemplary embodiment of lateral pallet spacer 160 is shown in FIG. 27. Pallet spacer 160 includes main body portion 178 and insertion tongue 180. Main body portion 178 is a generally cubic structure having a longitudinal aperture 182 formed therethrough (i.e., along the x-direction of the Cartesian coordinate system shown in FIG. 27). Aperture 182 allows for airflow in the x-direction to aid in cooling the bottom-most row of cases 22 for each of pallet assemblies 52 (FIG. 26). To this end, it is contemplated that pallets 4 may also include openings and/or air channels similar to spacers 30, 130 to allow for cooling of the bottom surfaces of the bottom most row of the cases 22.

Tongue 180 may have a tongue thickness $T_T$ and a sharpened tip 184, which cooperate to facilitate insertion of tongue 180 into pallet assembly 52 after cases 22 and spacers 130 have already been stacked upon pallet 4. More particularly, tongue 180 of spacer 130 may be inserted between an upper surface of pallet 4 and an adjacent lower surface of case 22, or an adjacent lower surface of spacer 130 where spacer 130 forms the bottom-most layer of pallet assembly 52. In an exemplary embodiment, thickness $T_T$ is about ⅛ inch. When inserted into assembly 52, the weight and pressure of cases 22 upon tongue 180 keeps each lateral pallet spacer 160 in place and in reliable abutment with the outer surface of pallet 4 as long as pallet assembly 52 remains loaded with cases 22. In order to control for the frictional retention force imparted by a given weight and pressure (which in turn depends on the nature and amount of product stored in cases 22), tongue 180 may define a variable tongue length $L_T$ as low as 2 inches, 4 inches or 6 inches and as large as 8 inches, 10 inches or 12 inches. Depending on the application and the amount of frictional retention force desired, length $L_T$ may be any length within any range defined by any of the foregoing values. Because friction is the only force used to retain spacer 160 in its desired location, spacer 160 can be removed and installed among various pallet assemblies 52 with ease and repeatability, and without removing any of cases 22.

It is also contemplated that several other designs may be used to effect the functionality of lateral pallet spacers 160, including spacers integrally formed into pallets 4, spacers bolted or otherwise affixed onto pallets 4, or spacers attached to selected layers of cases 22. In addition, it is contemplated that handle 186 may span the inner walls of aperture 182, to facilitate a firm grip when inserting or removing spacer 160 from pallet assembly 52. In FIG. 27, handle 186 is shown extending generally horizontally across aperture 182, though it is also contemplated that handle 186 may extend vertically or at a chosen angle. Other gripping mechanisms may be provided instead of, or in addition to, handle 186 on lateral pallet spacer 160. Such other gripping mechanisms may be alternative gripping portions disposed within aperture 182, or knurling of main body 178, for example.

Dimension D of main body portion 178 of spacer 160, which is the longitudinal dimension thereof in the x-direction, may be set at any desired nominal value in order to create a sufficient size of intra-pallet manifold space 176 (FIG. 26). In an exemplary embodiment, dimension D may be as little as 2 inches, 3 inches or 5 inches, or may be as large as 8 inches, 10 inches or 12 inches, or may be any dimension within any range defined by any of the foregoing values. Height HT of main body portion 178, which is the longitudinal dimension in the Z-direction, may be between 3 inches and 5 inches and may be set to correspond with a particular height of pallet 4, for example.

Other exemplary structures, systems and methods made in accordance with the present disclosure are described in U.S. patent application Ser. No. 13/844,078, filed Mar. 15, 2013 and entitled SPACER FOR A WAREHOUSE RACK-AISLE HEAT TRANSFER SYSTEM, the entire disclosure of which is hereby expressly incorporated herein by reference.

While this disclosure has been described as having an exemplary design, the present invention can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. An installation for cooling to a desired temperature, heating to the desired temperature or maintaining at the desired temperature a quantity of product, the installation comprising:

a rack assembly defining a plurality of bays, each of the plurality of bays sized to receive a first pallet assembly and a second pallet assembly along a bay depth, the first pallet assembly and the second pallet assembly each defining and airflow pathway therethrough;

an air flow chamber in fluid communication with an airflow opening adjacent each of the plurality of bays of the rack assembly, each airflow opening sized and positioned to facilitate airflow through an adjacent one of the plurality of bays;

a fan in fluid communication with the air flow chamber, the fan operable to create a circulation of air through the plurality of bays via respective airflow openings; and a lateral pallet spacer oriented to abut the first pallet assembly and the second pallet assembly when the first pallet assembly and the second pallet assembly are received next to one another along the bay depth, such that the lateral pallet spacer maintains a lateral separation space between the first pallet assembly and the second pallet assembly.

2. The installation of claim 1, wherein the rack assembly is disposed in a warehouse space comprising an air handler operable to condition ambient air in the warehouse space, the air handler having an output sufficient to achieve and maintain a temperature of the ambient air in the warehouse space at the desired temperature.

3. The installation of claim 2, wherein the air handler comprises a chiller operable to maintain the temperature of the ambient air in the warehouse space at the desired temperature of −5° F. to −30° F.

4. The installation of claim 1, wherein the fan is positioned to circulate air through the first and second pallet assemblies along the bay depth, and finally into the air flow chamber.

5. The installation of claim 1, wherein the first pallet assembly and the second pallet assembly each comprises:

a pallet having a case support surface defining a case support surface area;

a plurality of cases supported by the case support surface area in a plurality of case layers; and at least one product spacer comprising a substantially planar upper support surface extending in an x-y plane of a Cartesian coordinate system, the upper support surface defining a spacer outer perimeter of a size and shape about congruent to the case support surface area of the pallet, and a substantially planar lower support surface spaced from the upper support surface along a z-direction of the Cartesian coordinate system; and a plurality of supports extending between the upper support surface and the lower support surface along a trajectory having a directional component along a z-axis of the Cartesian coordinate system, whereby each of the plurality of supports space the upper support surface from the lower support surface, the upper support surface, the lower support surface and the supports cooperating to define the airflow pathway along an x-direction of the Cartesian coordinate system, the airflow pathway spanning a pair of opposing sides of the at least one product spacer.

6. The installation of claim 5, wherein the lateral pallet spacer protrudes outwardly from the case support surface area of one of the first and second pallet assemblies, and is oriented to abut the other of the first and second pallet assemblies when the first and second pallet assemblies are arranged along the bay depth.

7. The installation of claim 5, wherein the first pallet assembly is arranged along the bay depth in an upstream location in direct fluid communication a respective adjacent airflow opening, such that a circulation created by the fan causes airflow through the airflow pathway in the at least one product spacer of the first pallet assembly in the upstream location, then into the lateral separation space between the first and second pallet assemblies arranged along the bay depth, and then through the airflow pathway in the second pallet assembly.

8. The installation of claim 5, wherein:

a first longitudinal end of the airflow pathway comprises an airflow inlet and a second, opposing longitudinal end of the airflow pathway comprises an airflow outlet, whereby an airflow enters the airflow pathway at the airflow inlet, traverses the airflow pathway and exits the airflow pathway at the airflow outlet to define an airflow trajectory from the airflow inlet to the airflow outlet along an x-axis of the Cartesian coordinate system; and adjacent ones of the supports substantially preclude the airflow from exiting the airflow pathway along a trajectory defined by a y-axis of the Cartesian coordinate system.

9. The installation of claim 5, wherein the longitudinal extent of the airflow pathway is substantially linear along the x-direction.

10. The installation of claim 5, wherein the lateral pallet spacer comprises a tongue configured to be inserted under one of the plurality of case layers, and a main body extending outwardly away from the plurality of case layers.

11. The installation of claim 10, wherein the main body of the lateral pallet spacer comprises an aperture oriented along the direction of airflow from the upstream pallet assembly toward the downstream pallet assembly.

12. The installation of claim 11, wherein the main body of the lateral pallet spacer has a dimension along the direction of airflow between 2 inches and 12 inches.

13. A method of maintaining a quantity of a product at a desired temperature, comprising:

loading a first pallet assembly and a second pallet assembly into a bay of a rack assembly, such that the first pallet assembly is adjacent an airflow opening in the rack assembly and the second pallet assembly is adjacent the first pallet assembly and spaced from the airflow opening;

disposing a lateral pallet spacer between the first pallet assembly and the second pallet assembly; and directing a thermally conditioned airflow into the bay, through an upstream one of the first and second pallet assemblies, into a manifold space created by the lateral pallet spacer, and then into a downstream one of the first and second pallet assemblies.

14. The method of claim 13, further comprising preparing the first and second pallet assemblies by stacking a plurality of cases and a plurality of spacers on respective pallets so that respective rows of the plurality of cases are separated from each one another along a z-axis of a Cartesian coordinate system by the spacers, the spacers comprising:

a substantially planar upper support surface extending in an x-y plane of the Cartesian coordinate system, the upper support surface defining a spacer outer perimeter of a size and shape about congruent to a case support surface area of a pallet;

a substantially planar lower support surface spaced from the upper support surface along a z-direction of the Cartesian coordinate system;

a plurality of supports extending between the upper support surface and the lower support surface along a trajectory having a directional component along the z-axis, whereby each of the plurality of supports space the upper support surface from the lower support surface, the upper support surface, the lower support surface and the supports cooperating to define at least one longitudinal airflow channel extending along an x-direction of the Cartesian coordinate system, the at least one longitudinal airflow channel spanning a pair of opposing sides of the respective spacer.

15. The method of claim 14, wherein affixing the lateral pallet spacer to one of the first pallet assembly and the second pallet assembly comprises affixing the lateral pallet spacer to a case support area of each pallet assembly such that the lateral pallet spacer protrudes outwardly from the pallet assembly along the x-direction.

16. The method of claim 13, wherein the step of disposing the lateral pallet spacer between the first pallet assembly and the second pallet assembly comprises affixing the lateral pallet spacer to one of the first pallet assembly and the second pallet assembly.

17. An installation for cooling to a desired temperature, heating to the desired temperature or maintaining at the desired temperature a quantity of product, the installation comprising:

a rack assembly defining a plurality of bays, each of the plurality of bays sized to receive a pallet assembly defining and airflow pathway therethrough;

an air flow chamber in fluid communication with an airflow opening adjacent each of the plurality of bays of the rack assembly, each airflow opening sized and positioned to facilitate airflow through an adjacent one of the plurality of bays;

a fan in fluid communication with the air flow chamber, the fan operable to create a circulation of air through the plurality of bays via respective airflow openings; and an air dam pivotably connected within each of the plurality of bays, each air dam positioned to pivot into a engaged position abutting a surface of the pallet assembly when the pallet assembly is received in a respective one of the plurality of bays, and into a disengaged position in which at least a portion of the air dam occupies a portion of the respective bay normally occupied by the pallet assembly.

18. The installation of claim 17, wherein the air dam is pivotally affixed to a top panel of the respective one of the plurality of bays, whereby an upper surface of the pallet assembly abuts the air dam and causes the air dam to pivot upwardly as the pallet assembly passes into the bay.

19. The installation of claim 17, wherein the air dam is a substantially rigid structure.

20. The installation of claim 19, further comprising a biasing element urging the air dam into engagement with the surface of the pallet assembly.

21. The installation of claim 17, wherein the fan is configured to produce a positive air pressure on an upstream surface of the air dam, such that the positive air pressure urges the air dam toward the engaged position.

22. The installation of claim 17, wherein:

the bay of the rack assembly is sized to receive a first pallet assembly and a second pallet assembly along a bay depth; and the air dam comprises a plurality of air dams disposed at respective pallet positions along the bay depth.

23. The installation of claim 17, wherein lateral sides of bay are sealed by sidewalls, a lower side of the bay is sealed by a floor panel, and an upper side of the bay is sealed by a ceiling panel.

24. The installation of claim 17, wherein the plurality of bays are arranged along a series of horizontal rows and vertical columns of the rack assembly.

* * * * *